US009011279B2

(12) United States Patent
Johnson

(10) Patent No.: US 9,011,279 B2
(45) Date of Patent: Apr. 21, 2015

(54) THROWING DART

(71) Applicant: Lanny L. Johnson, Frankfort, MI (US)

(72) Inventor: Lanny L. Johnson, Frankfort, MI (US)

( * ) Notice: Subject to any disclaimer, the term of this patent is extended or adjusted under 35 U.S.C. 154(b) by 0 days.

(21) Appl. No.: 14/333,664

(22) Filed: Jul. 17, 2014

(65) Prior Publication Data

US 2014/0329624 A1 Nov. 6, 2014

Related U.S. Application Data

(62) Division of application No. 13/772,005, filed on Feb. 20, 2013, now abandoned.

(60) Provisional application No. 61/601,075, filed on Feb. 21, 2012.

(51) Int. Cl.

| | |
|---|---|
| ***A63B 65/02*** | (2006.01) |
| ***F42B 6/00*** | (2006.01) |
| ***A63B 59/00*** | (2006.01) |
| ***A63D 15/08*** | (2006.01) |
| ***A63B 49/06*** | (2006.01) |
| *A63B 71/06* | (2006.01) |
| *F41C 23/10* | (2006.01) |
| *F41C 23/14* | (2006.01) |
| *F41C 23/16* | (2006.01) |

(52) U.S. Cl.

CPC ..... *F42B 6/003* (2013.01); *A63B 59/0014* (2013.01); *A63B 59/0077* (2013.01); *A63D 15/08* (2013.01); *A63B 49/06* (2013.01); *A63B 2071/0655* (2013.01); *F41C 23/10* (2013.01); *F41C 23/14* (2013.01); *F41C 23/16* (2013.01)

(58) Field of Classification Search

USPC ..... 473/578

See application file for complete search history.

(56) References Cited

U.S. PATENT DOCUMENTS

| | | | |
|---|---|---|---|
| 242,877 | A | 6/1881 | Bryant |
| 729,639 | A | 6/1903 | McCoy |
| 774,621 | A | 11/1904 | Van Setres |
| 834,711 | A | 10/1906 | Clarke |
| 878,524 | A | 2/1908 | Gregory |
| 1,025,478 | A | 5/1912 | Murphy |

(Continued)

FOREIGN PATENT DOCUMENTS

| | | |
|---|---|---|
| EP | 1452208 A1 | 9/2004 |
| JP | 2003180892 | 7/2003 |

OTHER PUBLICATIONS

International Search Report and Written Opinion of the International Searching Authority for International Application No. PCT/US2011/204453 mailed Apr. 5, 2011, 12 pages.

*Primary Examiner* — John Ricci

(74) *Attorney, Agent, or Firm* — David J. Dawsey; Michael J. Gallagher; Gallagher & Dawsey Co., LPA

(57) ABSTRACT

A throwing dart having a handle that provides a user with tactile biofeedback. The handle includes a handle body having an exterior body surface defined by a first octant, a second octant, a third octant, a fourth octant, a fifth octant, a sixth octant, a seventh octant, and an eighth octant. The handle includes at least a first tactile reference indentation, or projection, that extends longitudinally along the exterior body surface and is confined to a first tactile octant. The first tactile reference indentation, or projection, is formed with dimensions specifically tailored to harness the user's natural attributes of sensibility, proprioception, and neuromuscular memory to improve a user's accuracy.

18 Claims, 16 Drawing Sheets

(56) References Cited

U.S. PATENT DOCUMENTS

| | | | | |
|---|---|---|---|---|
| 1,149,834 | A | 8/1915 | James | |
| 1,488,900 | A | 4/1924 | Armstrong | |
| 1,556,781 | A | 10/1925 | Emil | |
| 1,587,082 | A | 6/1926 | Mattern | |
| 1,604,696 | A | 10/1926 | Jordy | |
| 2,099,521 | A | 11/1937 | Herkimer et al. | |
| 2,166,044 | A | 7/1939 | Lewthwaith et al. | |
| D128,266 | S | 7/1941 | Smith | |
| 2,280,382 | A | 4/1942 | Davis | |
| D160,396 | S | 10/1950 | Karns | |
| D172,416 | S | 6/1954 | Brandon | |
| D173,110 | S | 9/1954 | Karns | |
| D174,183 | S | 3/1955 | Karns | |
| 2,871,899 | A | 2/1959 | Coyle et al. | |
| 2,983,512 | A | 5/1961 | Fleischer | |
| 3,109,653 | A | 11/1963 | Biggs | |
| D210,468 | S | 3/1968 | Brewer | |
| 3,606,326 | A | 9/1971 | Sparks | |
| 3,706,453 | A | 12/1972 | Rosasco | |
| 4,134,588 | A | 1/1979 | Di Luzio | |
| 4,222,562 | A | 9/1980 | Gardner | |
| 4,466,610 | A | 8/1984 | Israel | |
| 4,537,403 | A | 8/1985 | Farina | |
| D295,207 | S | 4/1988 | Mahaffey | |
| 4,795,158 | A | 1/1989 | Kuykendall | |
| D307,169 | S | 4/1990 | Aldridge | |
| 4,919,420 | A | 4/1990 | Sato | |
| 4,932,659 | A | 6/1990 | Freeberg | |
| 4,949,965 | A | 8/1990 | Ross, Jr. et al. | |
| 4,974,846 | A | 12/1990 | Fenton | |
| 5,087,042 | A | 2/1992 | Solheim | |
| 5,133,555 | A | 7/1992 | Bailey | |
| 5,152,533 | A | 10/1992 | Radakovich | |
| 5,158,297 | A | 10/1992 | Johnson | |
| 5,165,681 | A | 11/1992 | Enger et al. | |
| 5,193,246 | A | 3/1993 | Huang | |
| 5,217,380 | A | 6/1993 | Martinet | |
| 5,248,141 | A | 9/1993 | Kelly | |
| 5,273,293 | A * | 12/1993 | Lekavich | 473/578 |
| D345,192 | S | 3/1994 | Solheim | |
| 5,348,303 | A | 9/1994 | Swissheim | |
| D357,295 | S | 4/1995 | Solheim | |
| 5,558,584 | A | 9/1996 | Brown | |
| 5,575,724 | A | 11/1996 | Hannon et al. | |
| D376,400 | S | 12/1996 | Nakazaki | |
| 5,590,437 | A | 1/1997 | McMillin | |
| 5,634,859 | A | 6/1997 | Nesbitt | |
| 5,637,043 | A | 6/1997 | Fortis | |
| 5,704,842 | A | 1/1998 | Petrusek | |
| D391,330 | S | 2/1998 | Solheim | |
| 5,788,582 | A | 8/1998 | Shapiro | |
| 5,788,588 | A | 8/1998 | Hooker | |
| 5,897,440 | A | 4/1999 | Bae et al. | |
| 6,022,278 | A | 2/2000 | Vela | |
| D431,851 | S | 10/2000 | Anderson | |
| 6,129,642 | A * | 10/2000 | DonTigny | 473/578 |
| D435,074 | S | 12/2000 | Dunham | |
| 6,155,930 | A | 12/2000 | Madara | |
| 6,500,079 | B1 | 12/2002 | Tucker, Sr. | |
| 6,591,456 | B2 | 7/2003 | DeLuca et al. | |
| 6,595,880 | B2 * | 7/2003 | Becker | 473/578 |
| 6,605,005 | B1 | 8/2003 | Lin | |
| 6,609,981 | B2 | 8/2003 | Hirata | |
| 6,656,054 | B2 | 12/2003 | Ulrich | |
| 6,656,057 | B2 | 12/2003 | Manual et al. | |
| 6,718,675 | B1 | 4/2004 | Lu | |
| 6,746,336 | B1 | 6/2004 | Brant et al. | |
| 6,758,760 | B1 | 7/2004 | Kellogg et al. | |
| 6,840,869 | B2 | 1/2005 | Chen | |
| 6,908,400 | B2 | 6/2005 | Chu et al. | |
| 6,921,340 | B2 | 7/2005 | Dickie | |
| 6,929,555 | B2 | 8/2005 | Morton | |
| D512,758 | S | 12/2005 | Tuerschmann et al. | |
| 7,175,538 | B2 | 2/2007 | Miller | |
| 7,201,678 | B2 | 4/2007 | Filice et al. | |
| D548,807 | S | 8/2007 | Miller | |
| D548,808 | S | 8/2007 | Chen | |
| 7,326,135 | B2 | 2/2008 | Lussier et al. | |
| 7,351,167 | B1 | 4/2008 | Hathaway | |
| 7,371,196 | B2 | 5/2008 | Morrow et al. | |
| 7,416,499 | B2 | 8/2008 | Tucker | |
| 7,485,050 | B2 | 2/2009 | Rose | |
| 7,537,525 | B2 | 5/2009 | Wang | |
| 7,637,821 | B2 | 12/2009 | Johnson | |
| 7,776,004 | B2 | 8/2010 | Yarger | |
| 7,789,777 | B2 | 9/2010 | Tucker | |
| 7,794,332 | B2 | 9/2010 | Johnson | |
| 7,874,181 | B1 | 1/2011 | Lindahl | |
| 7,967,188 | B2 | 6/2011 | Hickox | |
| 7,972,227 | B2 | 7/2011 | Lamson | |
| 8,062,147 | B2 | 11/2011 | Johnson | |
| 8,092,317 | B2 | 1/2012 | Johnson | |
| 2002/0072423 | A1 | 6/2002 | Pot | |
| 2002/0169031 | A1 | 11/2002 | Wallace et al. | |
| 2003/0013539 | A1 | 1/2003 | Scott et al. | |
| 2003/0083142 | A1 | 5/2003 | Nam | |
| 2004/0005932 | A1 | 1/2004 | Kuo | |
| 2004/0077428 | A1 | 4/2004 | Oliver et al. | |
| 2004/0116196 | A1 | 6/2004 | Nazaruk | |
| 2004/0185955 | A1 | 9/2004 | Rocconi | |
| 2004/0192458 | A1 | 9/2004 | Daniels | |
| 2004/0224781 | A1 | 11/2004 | Davtyan et al. | |
| 2004/0259655 | A1 | 12/2004 | Ferris | |
| 2004/0259657 | A1 | 12/2004 | Heller et al. | |
| 2005/0026712 | A1 | 2/2005 | Byrd et al. | |
| 2005/0187030 | A1 | 8/2005 | Miller | |
| 2006/0030418 | A1 | 2/2006 | Evans et al. | |
| 2006/0068148 | A1 | 3/2006 | Ulrich | |
| 2006/0212056 | A1 | 9/2006 | Salvadori et al. | |
| 2006/0287124 | A1 | 12/2006 | Han et al. | |
| 2007/0082748 | A1 | 4/2007 | Rose | |
| 2007/0129186 | A1 | 6/2007 | Appleton | |
| 2007/0259732 | A1 | 11/2007 | Billings et al. | |
| 2008/0102974 | A1 | 5/2008 | Nam | |
| 2008/0176685 | A1 | 7/2008 | Madore et al. | |
| 2008/0230174 | A1 | 9/2008 | Huang | |
| 2008/0305883 | A1 | 12/2008 | Cameron | |
| 2009/0017935 | A1 | 1/2009 | Wang et al. | |
| 2009/0023512 | A1 | 1/2009 | Watson | |
| 2009/0082122 | A1 | 3/2009 | Kellogg | |
| 2009/0170641 | A1 | 7/2009 | Qin et al. | |
| 2009/0217631 | A1 | 9/2009 | Pepin et al. | |
| 2009/0239689 | A1 | 9/2009 | Baxter et al. | |
| 2009/0253528 | A1 | 10/2009 | Brolly | |
| 2010/0009787 | A1 | 1/2010 | Vacek et al. | |
| 2010/0102479 | A1 | 4/2010 | Wallis | |
| 2010/0317469 | A1 | 12/2010 | Comello et al. | |
| 2012/0034993 | A1 | 2/2012 | Johnson | |

* cited by examiner

THROWING DART

CROSS-REFERENCE TO RELATED APPLICATIONS

This application is a divisional application of U.S. patent application Ser. No. 13/772,005, filed on Feb. 20, 2013, which claims the benefit of U.S. provisional patent application Ser. No. 61/601,075, filed on Feb. 21, 2012, all of which are incorporated by reference as if completely written herein.

TECHNICAL FIELD

The present disclosure relates to the field of sports equipment, and more particularly, to a sports equipment handle that provides a user with tactile biofeedback.

BACKGROUND OF THE INVENTION

The sports equipment handle is perhaps the most overlooked and underappreciated piece of sports equipment. Sports equipment handle technology has changed very little over the past few decades.

For the most part, the sports equipment handle has not been considered as a means for game improvement. Rather, the sports industry has primarily focused on the impact head of a racquet or paddle, cue tip, materials of construction, aerodynamics, and projectile advancements as the sole means for helping improve the sportsman's game. Many modern racquets, paddles, and bats are designed to be more forgiving when a sportsman does not hit the ball in the sports equipment's sweet spot, or makes an errant throw. However, modern racquets, paddle heads, cue sticks, bat bodies, dart bodies, and archery/firearm designs do very little to help a sportsman consistently hit the ball in the sports equipment's sweet spot or make consistent accurate shots or throws.

Interestingly, the sports industry has ignored the only physical connection between the sportsman and the sports equipment (i.e., the sports equipment handle) as a vehicle for solving the problem of a sportsman's game performance. The presently disclosed sport equipment handle solves the problem by providing at least one tactile structure that harnesses the innate attributes and processes of the sportsman's body.

SUMMARY OF INVENTION

In its most general configuration, the presently disclosed sport equipment handle advances the state of the art with a variety of new capabilities and overcomes many of the shortcomings of prior devices in new and novel ways. The presently disclosed sport equipment handle overcomes the shortcomings and limitations of the prior art in any of a number of generally effective configurations. The presently disclosed sport equipment handle demonstrates such capabilities and overcomes many of the shortcomings of prior methods in new and novel ways.

The present disclosure relates to a sport equipment handle that provides a user with tactile biofeedback. The sport equipment handle includes a handle body having an upper portion, a lower portion, a handle length, a proximal end, a distal end, and an exterior body surface. The exterior body surface is defined by a first octant, a second octant, a third octant, a fourth octant, a fifth octant, a sixth octant, a seventh octant, and an eighth octant. The sports equipment handle includes at least a tactile reference indentation or projection that extends longitudinally along the exterior body surface. The tactile reference indentation or projection is formed with dimensions specifically tailored to harness the user's natural attributes of sensibility, proprioception, and neuromuscular memory to enable the user to consistently hit a projectile with accuracy, throw a projectile with accuracy, or shoot a projectile with accuracy.

BRIEF DESCRIPTION OF THE DRAWINGS

Without limiting the scope of the sports equipment handle and system as claimed below and referring now to the drawings and figures:

FIG. 1 (B) is a front elevation view of an embodiment of a sports equipment handle on a baseball bat, not to scale;

Figure 1:
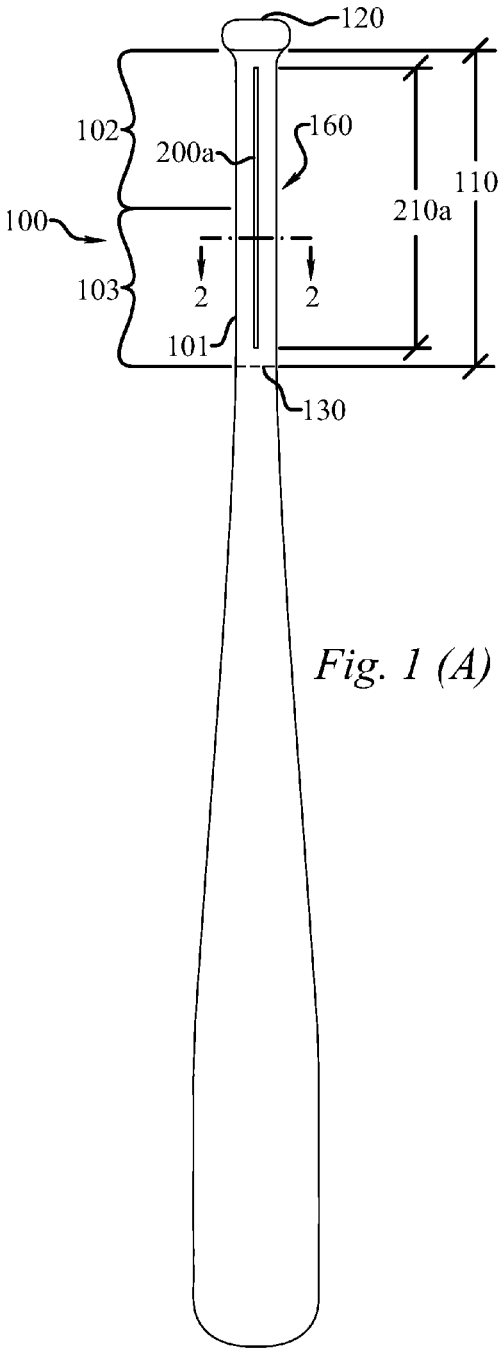
FIG. 1 (A) is a front elevation view of an embodiment of a sports equipment handle on a baseball bat, not to scale.
Figure 1:
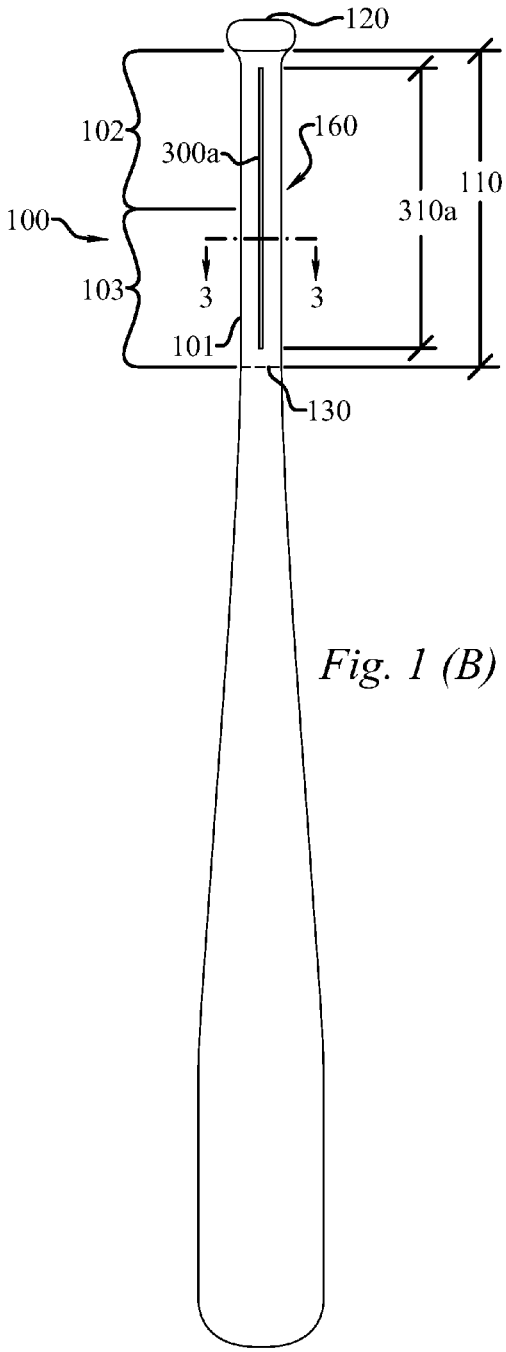

These drawings are provided to assist in the understanding of the exemplary embodiments of the presently disclosed sports equipment handle as described in more detail below and should not be construed as unduly limiting the sports equipment handle and system. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

A sports equipment handle (100) that provides a user with tactile biofeedback enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the sports equipment handle (100), and is not intended to represent the only form in which the present sports equipment handle (100) may be constructed or utilized. The description sets forth the designs, functions, means, and methods of gripping the sports equipment handle (100) in connection with the illustrated embodiments. It is to be understood, however, that the same or equivalent functions and features may be accomplished by different embodiments that are also intended to be encompassed within the spirit and scope of the sports equipment handle (100).

FIGS. 1-30 illustrate numerous embodiments of a sports equipment handle (100) that provides a user with tactile biofeedback. The sports equipment handle (100) includes at least one tactile structure specifically tailored to exploit and harness the innate attributes and processes of the human body to allow the user to consistently hit, throw, or shoot a projectile with accuracy.

Referring now to FIG. 1 (A), an embodiment of a sports equipment handle (100) on a baseball bat is illustrated. As seen in FIG. 1 (A), the sports equipment handle (100) includes a handle body (101) having an upper portion (102), a lower portion (103), a handle length (110), a proximal end (120), a distal end (130), and an exterior body surface (160). The upper portion (102) and the lower portion (103) correspond to the portion of the handle body (101) that is above the midpoint of the handle length (110) and below the midpoint of the handle length (110), respectively. Generally, for a right-handed user using a conventional gripping style, the upper portion (102) is where a majority of the user's left hand would grasp the sports equipment handle (100) and the lower portion (103) is where a majority of the user's right hand would grasp the sports equipment handle (100).

Figure 2:
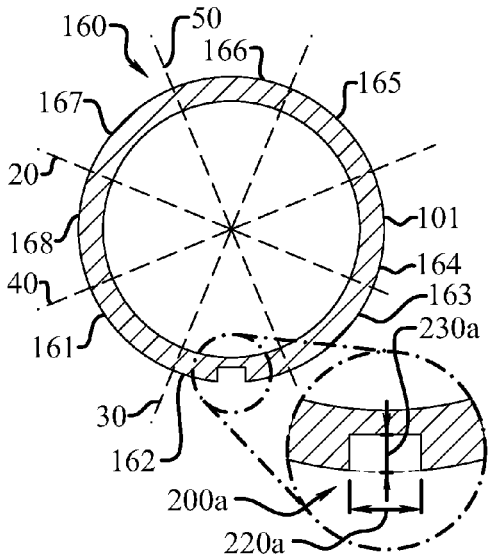
FIG. 2 is a cross-sectional view of the embodiment of the sports equipment handle taken along section line 2-2, not to scale.

As seen in FIG. 2, in this embodiment the handle body (101) has a substantially circular cross-section throughout the handle length (110), however the present invention is not limited to circular handles. The exterior body surface (160) is defined by a first octant (161), a second octant (162), a third octant (163), a fourth octant (164), a fifth octant (165), a sixth octant (166), a seventh octant (167), and an eighth octant (168). The octants (161, 162, 163, 164, 165, 166, 167, 168) are defined by the intersection of four imaginary vertical planes (20, 30, 40, 50), with each vertical plane (20, 30, 40, 50) spaced 45 degrees from the adjacent vertical planes (20, 30, 40, 50), as seen well in FIG. 2. Preferably, the four imaginary vertical planes (20, 30, 40, 50) intersect at the geometric center of the proximal end (120), i.e., the butt end, of the sports equipment handle (100); however the planes may be positioned to pass the a cross-sectional centroid of the handle. The four imaginary vertical planes (20, 30, 40, 50) may be rotated about the geometric center of the proximal end (120) to define a position of the octants (161, 162, 163, 164, 165, 166, 167, 168). Moreover, the sports equipment handle (100) may include visual indicia, such as painted lines, on the exterior body surface (160) that visually delineates the octants (161, 162, 163, 164, 165, 166, 167, 168). The tactile reference indentations (200) illustrated in FIGS. 2, 4, 6, and 8 have flat sidewalls and a flat bottom, but this is not necessary. The tactile reference indentations may have a "V" shaped cross-section or even a curved bottom cross-section, it is more important that the surface edges of the tactile reference indentations (200) have very small, or no, radius of curvature so that the edges are very distinct. In one embodiment, radius of curvature from the indentation (200) sidewall to the adjacent handle, or grip, surface is 0.35 millimeters or less. Such a dimension for the radius of curvature accommodates two-point discrimination by making the edge relatively fine and thus capable of distinction by feel. In another embodiment this radius of curvature is zero, meaning that the indentation and the adjacent handle, or grip, meet at a distinct line. In an even further embodiment, and as illustrated in FIG. 2, the indentation (200) sidewalls meet the adjacent handle, or grip, surface at substantially a 90 degree angle.

As seen in the embodiment of FIG. 1 (A), the sports equipment handle (100) includes at least a tactile reference indentation (200*a*) extending longitudinally along the exterior body surface (160). The tactile reference indentation (200*a*) has a tactile reference indentation length (210*a*), a tactile reference indentation width (220*a*), and a tactile reference indentation depth (230*a*), as seen in FIGS. 1 (A) and 2. The tactile reference indentation (200*a*) is confined to a first tactile octant selected from the group consisting of the first octant (161), the second octant (162), the third octant (163), the fourth octant (164), the fifth octant (165), the sixth octant (166), the seventh octant (167), and the eighth octant (168). In the embodiment of FIG. 2 the first tactile octant is the second octant (162) and the tactile reference indentation (200*a*) is confined to the second octant (162). However, the first tactile octant may be the first octant (161), the third octant (163), the fourth octant (164), the fifth octant (165), the sixth octant (166), the seventh octant (167), or the eighth octant (168).

In this particular embodiment, there is only the tactile reference indentation (200*a*) in the first tactile octant. It should be noted that while this particular embodiment includes "only" the tactile reference indentation (200*a*) in the first tactile octant, this does not mean that the exterior body surface (160) cannot have additional surface patterns, texture changes, or other similar features. When the term "only" is used in connection with describing a tactile reference indentation (200*a*) in certain tactile octants (i.e., "there is only the tactile reference indentation (200*a*) in the first octant"), it means that the tactile octants do not contain any additional palpable indicia adjacent to the tactile reference indentation (200*a*). The term palpable indicia, as used throughout this specification, means a structure having a depth or height of at least 0.4 millimeters, a width of at least 1.0 millimeters, and a length of at least 25 millimeters.

Figure 3:
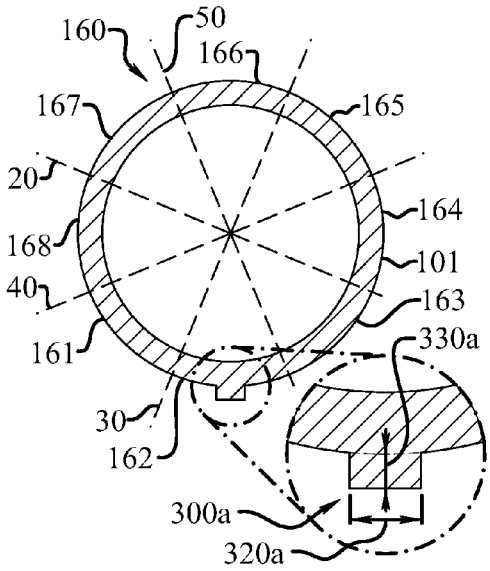
FIG. 3 is a cross-sectional view of an embodiment of a sports equipment handle taken along section line 3-3, not to scale.

In another embodiment of the sports equipment handle (100), the sports equipment handle (100) may include a tactile reference projection (300*a*) extending longitudinally along the exterior body surface (160), as seen in FIGS. 1 (B) and 3. The tactile reference projection (300*a*) has a tactile reference projection length (310*a*), tactile reference projection width (320*a*), and a tactile reference projection height (330*a*), as seen in FIG. 3. The tactile reference projection (300*a*) is confined to a first tactile octant selected from the group consisting of the first octant (161), the second octant (162), the third octant (163), the fourth octant (164), the fifth octant (165), the sixth octant (166), the seventh octant (167), and the eighth octant (168). As seen in FIG. 3, in this embodiment the first tactile octant is the second octant (162) and the tactile reference projection (300*a*) is confined to the second octant (162). However, the first tactile octant may also be the first octant (161), the third octant (163), the fourth octant (164), the fifth octant (165), the sixth octant (166), the seventh octant (167), or the eighth octant (168). The tactile reference projections (300) illustrated in FIGS. 3, 5, 7, and 9 have flat sidewalls and a flat top, but this is not necessary. The tactile reference projections may have virtually any cross-sectional shape provided that the outermost surface has two relatively well defined longitudinal edges. In other words, while the intersection of the sidewall surfaces to the adjacent handle, or grip, may be smooth and nondistinct, it is more important that the edges along the outermost surface of the tactile reference projections (300) have very small, or no, radius of curvature so that the edges are very distinct. In one embodiment, radius of curvature from the projection (300) sidewall to the outermost surface of the projection (300) is 0.35 millimeters or less. Such a dimension for the radius of curvature accommodates two-point discrimination by making the edge relatively fine and thus capable of distinction by feel. In another embodiment this radius of curvature is zero, meaning that the projection and the adjacent projection sidewall meet at a distinct line. In an even further embodiment, and as illustrated in FIG. 3, the projection (300) sidewalls meet the adjacent outermost surface at substantially a 90 degree angle.

In this particular embodiment, as seen in FIG. 3, there is only the tactile reference projection (300*a*) in the first tactile octant. It should be noted that while this particular embodiment includes "only" the tactile reference projection (300*a*) in the first tactile octant, this does not mean that the exterior body surface (160) cannot have additional surface patterns, texture changes, or other similar features. When the term "only" is used in connection with describing a tactile reference projection (300*a*) in certain tactile octants (i.e., "there is only the tactile reference projection (300*a*) in the first octant"), it means that the tactile octants do not contain any additional palpable indicia adjacent the tactile reference projection (300*a*).

The tactile reference indentation width (220*a*) and the tactile reference projection width (320*a*) are at least 2.0 millimeters and no greater than 5.0 millimeters, and the tactile reference indentation depth (230*a*) and tactile reference projection height (330*a*) are at least 0.5 millimeters. These specific dimensions are important because they exploit several of the user's normal human body attributes to enable the user to consistently grip a sports equipment handle (100) and recognize the position of the handle in space, thereby improving a user's ability to hit, or throw, a projectile with accuracy. The sports equipment handle (100) enhances users perception and awareness of the "spatial" relationship of the instrument attached to the handle (100) allowing for improved performance. These attributes include sensibility, proprioception, and neuromuscular memory.

Sensibility is the body's ability to determine fine objects by feel. This ability is measured by what is known as two-point discrimination. Two-point discrimination is defined as the ability to discern that two nearby objects touching the skin are truly two distinct points, not one. The test for two-point discrimination is usually performed utilizing two sharp points. Typically, a person has the most sensibility on their finger pads and lips. A normal measurement for two-point discrimination on the finger pads is a width of 2.0 millimeters to 5.0 millimeters, while other body parts, such as the back, have much larger measurements due to less nerve endings. When the two points are closer together than the range of two-point discrimination a person cannot tell whether they are being contacted by one point or two points.

Proprioception is the unconscious perception of movement and spatial orientation arising from stimuli within the body itself. For humans, these stimuli are detected by nerves within the body, such as in joints, tendons, and muscles. A practical example of proprioception is the ability to close one's eyes and touch the index fingers of both hands together without looking. As a result of proprioception, the human body has the ability to know exactly where it is in space. The human body also has the ability to remember and repeat past movements, which are referred to as neuromuscular memory. As sensations are recorded by the body and movements are repeated over time, the body develops an ability to repeat movements without conscious effort.

A user's connection to a piece of sports equipment is established by what they perceive through the handle. The presently disclosed sports equipment handle (100) harnesses a user's sensibility by providing at least a tactile reference indentation (200*a*) or tactile reference projection (300*a*) extending longitudinally along the exterior body surface (160) of the sports equipment handle (100) to create an intimate connection between at least one of the user's hands and the sports equipment handle (100). As previously mentioned, the tactile reference indentation width (220*a*) and the tactile reference projection width (320*a*) is at least 2.0 millimeters and no greater than 5.0 millimeters, which, importantly, corresponds to the normal range for two-point discrimination on the finger pads, thumb, and/or palm to provide the user with tactile biofeedback. Moreover, most humans do not have the ability to perceive a structure having a depth of less than 0.5 millimeters and a width of less than 2.0 millimeters with the finger pads, thumb, and/or palm. As a result, providing at least a tactile reference indentation (200*a*) or tactile reference projection (300*a*) extending longitudinally along the exterior body surface (160) with a tactile reference indentation width (220*a*) or tactile reference projection width (320*a*) of at least 2.0 millimeters and no greater than 5.0 millimeters and a tactile reference indentation depth (230*a*) or tactile reference projection height (330*a*) of at least 0.5 millimeters, which provides the highest level of sensibility, allows the finger pads, thumb, and/or palm to function as high level neurological information collectors. The finger pads, thumb, and/or palm, as high level neurological information collectors, are able to recognize the location and orientation of the tactile reference indentation (200*a*) or the tactile reference projection (300*a*), which is in the same spatial relationship as the sports equipment handle. In sports in which the players typically wear gloves the tactile reference indentation depth (230*a*) or tactile reference projection height (330*a*) may be increased to overcome the loss of sensitivity as a result of the glove layer. In one embodiment directed to gloved sports the tactile reference indentation depth (230*a*) or tactile reference projection height (330*a*) is at least 1.0 millimeter, and more preferably at least 2.0 millimeters.

Due to the intimate connection and the high level of sensibility provided by the specifically tailored tactile reference indentation (200*a*) or the tactile reference projection (300*a*) of the sports equipment handle (100), the sports equipment becomes like an extension of the user's body. At this point, the user's natural ability of proprioception is engaged, which allows the user to unconsciously perceive and spontaneously direct the sports equipment's movement in space due to the high level of sensibility provided by tactile reference indentation (200*a*) or the tactile reference projection (300*a*) extending longitudinally along the exterior body surface (160) of the sports equipment handle (100). As a result, the user will know where the sports equipment is in space and can make conscious, or even unconscious, adjustments to ensure that the projectile is consistently hit, or thrown, with accuracy.

Additionally, the sports equipment handle (100) builds upon the beneficial attributes provided by the high level of sensibility and proprioception by utilizing the user's natural capacity for neuromuscular memory. When a user grasps the sports equipment handle (100) and makes a swing, throw, or aligns to take a shot, the user obtains neuromuscular memory from the sensations recorded in the hands via the tactile reference indentation (200*a*) or the tactile reference projection (300*a*), in addition to registering the entire body's spatial relationships through proprioception. This information is stored and fed back through the body to the hands so the various muscles and joints are able to repeat the recorded performance to be transferred to the sports equipment via the sports equipment handle (100). As a result, the sports equipment handle (100) allows the user to build neuromuscular memory to consistently strike, throw, or shoot a projectile with increased accuracy. The tactile reference indentation (200*a*) or the tactile reference projection (300*a*) provide heightened neurosensory input to facilitate proprioception and muscle memory.

Figure 10:
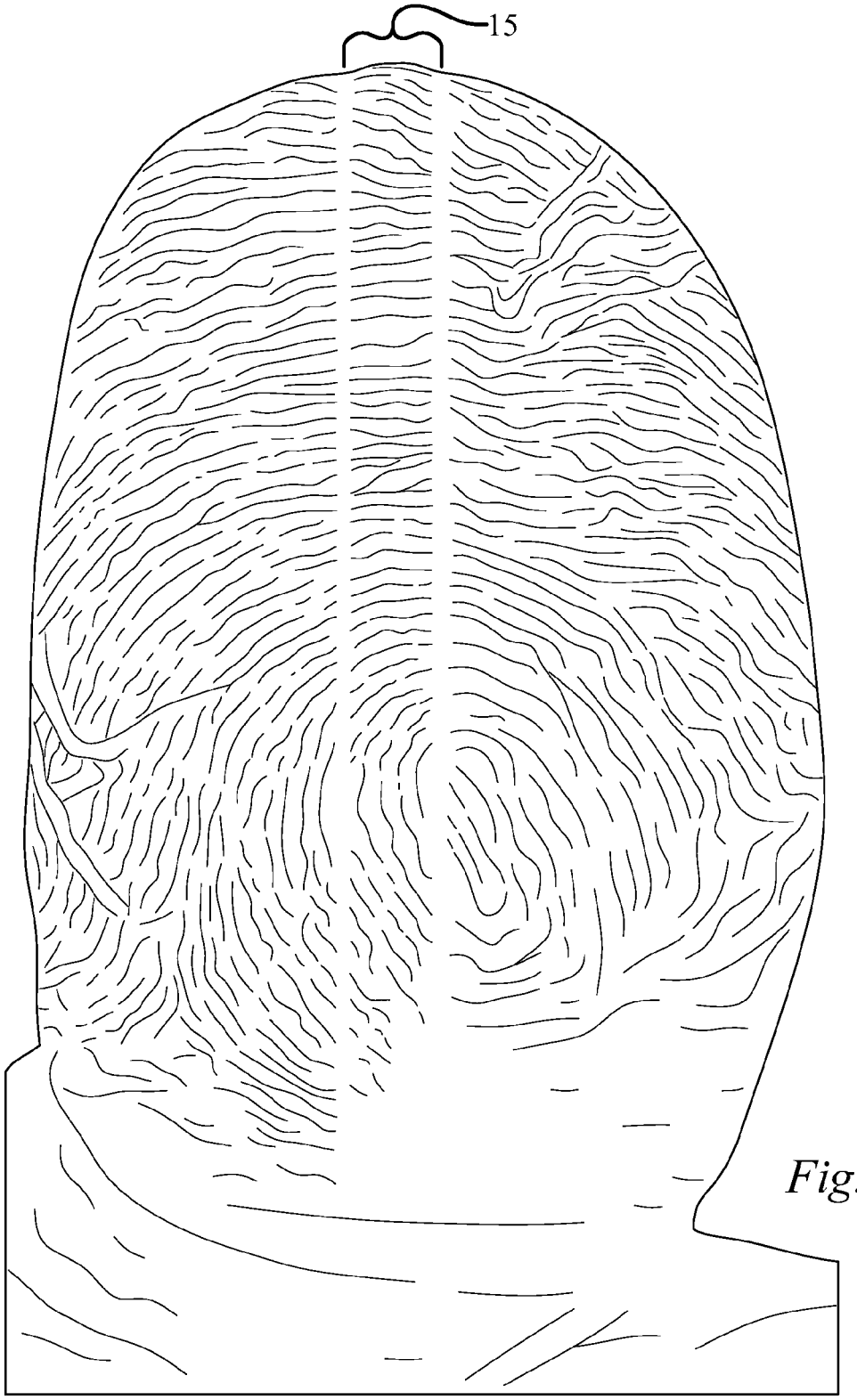
FIG. 10 is an elevation view of a user's thumb showing a dermal imprint, not to scale.

The sports equipment handle (100) on a piece of sports equipment may be custom tailored to the end users specifications such that the tactile reference indentation (200*a*) or the tactile reference projection (300*a*) coincides with a pre-selected, user preferred, hand and finger placement on the sports equipment handle (100). As such, the tactile reference indentation (200*a*) or the tactile reference projection (300*a*) additionally performs a "reminder" function. For example, the user will be able to feel the tactile reference indentation (200*a*) or the tactile reference projection (300*a*) and know whether they are grasping the sports equipment handle (100) with their preferred hand and finger placement. By knowing that the tactile reference indentation (200*a*) or the tactile reference projection (300*a*) coincides with the preferred hand and finger placement and being able to tactilely perceive tactile reference indentation (200*a*) or the tactile reference projection (300*a*), the user will have a higher level of psychomotor confidence, which results in hitting, throwing, or shooting a projectile with better accuracy. In fact, when the user grasps the sports equipment handle (100), the skin of their fingers, thumb, and/or palm will minimally sink into the tactile reference indentation (200*a*). As seen in FIG. 10, a dermal imprint (15) is formed when grasping the sports equipment handle (100). The dermal imprint (15) provides a very subtle and precise psychomotor alignment "read" for the user at the microdermal neurosensory level, which ultimately leads to better movement of the sports equipment.

In one embodiment, the tactile reference indentation length (210*a*) is at least 50 percent of the handle length (110). Having a tactile reference indentation (200*a*) that extends along at least 50 percent of the handle length (110) accommodates the numerous styles of hand positioning and gripping used to grasp a piece of sports equipment. Such a tactile reference indentation length (210*a*) maximizes the opportunity for the user's hands and fingers to come into contact with the tactile reference indentation (200*a*) to receive maximum psychomotor tactile biofeedback.

Figure 4:
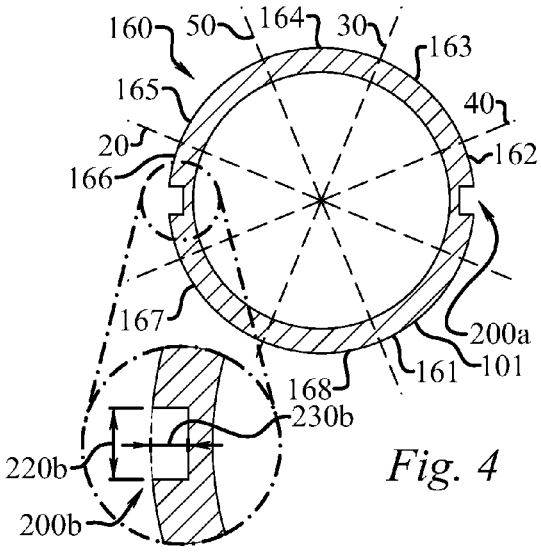
FIG. 4 is a cross-sectional view of an embodiment of a sports equipment handle, not to scale.

With reference now to FIG. 4, still another cross sectional embodiment of the sports equipment handle (100) is shown. In this particular embodiment, the sports equipment handle (100) further includes a second tactile reference indentation (200*b*) extending longitudinally along the exterior body surface (160). As seen in FIG. 4, the second tactile reference indentation (200*b*) is confined to a second tactile octant selected from the group consisting of the first octant (161), the second octant (162), the third octant (163), the fourth octant (164), the fifth octant (165), the sixth octant (166), the seventh octant (167), and the eighth octant (168) that does not include the tactile reference indentation (200*a*). The second tactile reference indentation (200*b*) has a second tactile reference indentation length (210*b*), a second tactile reference indentation width (220*b*) of at least 2.0 millimeters and no greater than 5.0 millimeters, and a second tactile reference indentation depth (230*b*) of at least 0.5 millimeters. In this embodiment, there is a first tactile reference indentation (200*a*) within the first tactile octant, and a second tactile reference indentation (200*b*) within the second tactile octant. Although FIG. 4 shows the tactile reference indentation (200*a*) in the second octant (162) and second tactile reference indentation (200*b*) in the sixth octant (166), the second tactile reference indentation (200*b*) may also be located in the first octant (161), the third octant (163), the fourth octant (164), the fifth octant (165), the seventh octant (167), or the eighth octant (168) with respect to the positioning of the tactile reference indentation (200*a*) and how the octants (161, 162, 163, 164, 165, 166, 167, 168) are defined in FIG. 4. Generally, the second tactile reference indentation (200*b*) should be spaced from the tactile reference indentation (200*a*) by at least a 10 degree angle, as measured from the point of intersection between the four imaginary vertical planes (20, 30, 40, 50), which point of intersection would typically be the geometric center of the proximal end (120), i.e., the butt end, of the sports equipment handle (100) from a top plan view. Such spacing ensures that first and second tactile reference indentations (200*a*, 200*b*) are not so close together that a user would not be able to discern by tactile perception the two distinct tactile reference indentations (200*a*, 200*b*).

By providing a second tactile reference indentation (200*b*), there is an increased opportunity for the user's hand(s), and associated finger pads, thumb, and/or palm, to come into contact with the tactile reference indentations (200*a*, 200*b*) in order to receive additional tactile biofeedback. As a result, the second tactile reference indentation (200*b*) provides even more information that is available for processing by the user's natural attributes of sensibility, proprioception, and neuromuscular memory to enable the user to consistently hit, throw, or shoot a projectile with accuracy.

The sports equipment handle (100) on a piece of sports equipment may be custom tailored to the end users specifications such that the tactile reference indentation (200*a*) and the second tactile reference indentation (200*b*) coincide with a pre-selected, user preferred, hand and finger placement on the sports equipment handle (100). As such, the first and second tactile reference indentations (200*a*, 200*b*) additionally perform a "reminder" function. For example, the user will be able to feel the first and/or second tactile reference indentations (200*a*, 200*b*) and know whether they are grasping the sports equipment handle (100) with their preferred hand and finger placement. By knowing that the first and/or second tactile reference indentations (200*a*, 200*b*) coincide with the preferred hand and finger placement and being able to tactilely perceive the first and second tactile reference indentation (200*a*, 200*b*), the user will have a higher level of psychomotor confidence, which results in a better sports equipment control.

Figure 6:
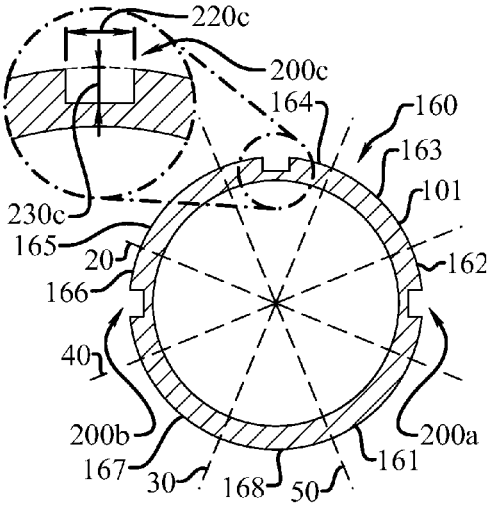
FIG. 6 is a cross-sectional view of an embodiment of the sports equipment handle, not to scale.
Figure 8:
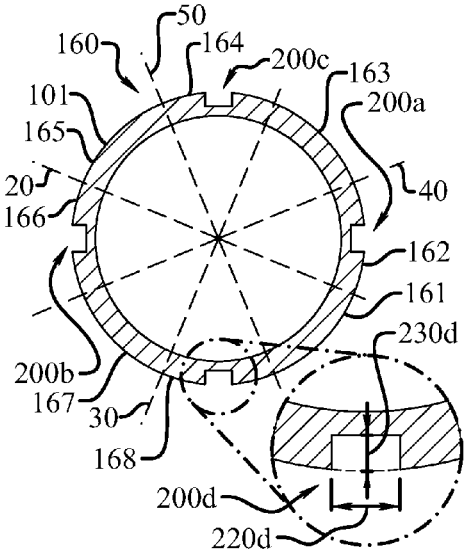
FIG. 8 is a cross-sectional view of an embodiment of a sports equipment handle, not to scale.

FIGS. 6 and 8 are cross-sectional views illustrating embodiments having multiple tactile reference indentations including at least two tactile reference indentations in non-adjacent octants and at least two non-adjacent octants having no palpable indicia. It should be noted that the embodiments shown in FIGS. 6 and 8 do not reflect all the possible combinations of arrangements at least two tactile reference indentations in non-adjacent octants and at least two non-adjacent octants having no palpable indicia but rather merely a few illustrative embodiments. Again, these embodiments ensure sufficient spacing of the tactile reference indentations (200*a*, 200*b*) to avoid providing competing tactile information that could be misinterpreted by the user's natural body processes of sensibility, proprioception, and neuromuscular memory.

Figure 5:
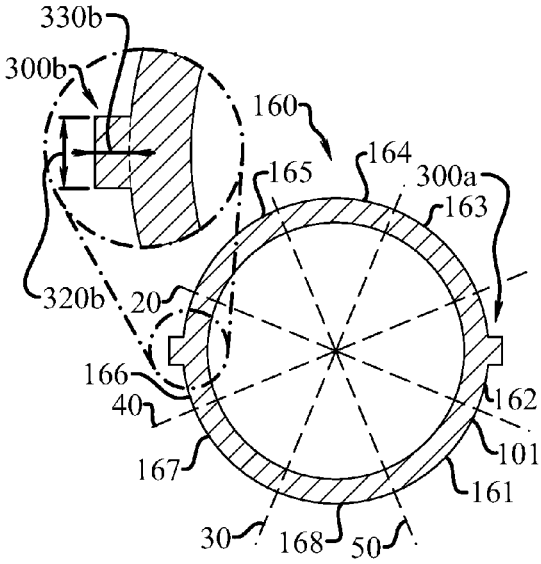
FIG. 5 is a cross-sectional view of an embodiment of the sports equipment handle, not to scale.

With reference now to FIG. 5, still another cross sectional embodiment of the sports equipment handle (100) is shown. In this particular embodiment, the sports equipment handle (100) further includes a second tactile reference projection (300*b*) extending longitudinally along the exterior body surface (160). As seen in FIG. 5, the second tactile reference projection (300*b*) is confined to a second tactile octant selected from the group consisting of the first octant (161), the second octant (162), the third octant (163), the fourth octant (164), the fifth octant (165), the sixth octant (166), the seventh octant (167), and the eighth octant (168) that does not include the tactile reference projection (300*a*). The second tactile reference projection (300*b*) has a second tactile reference indentation length (310*b*), a second tactile reference projection width (320*b*) of at least 2.0 millimeters and no greater than 5.0 millimeters, and a tactile reference projection depth (330*b*) of at least 0.5 millimeters. In this embodiment, there is a first tactile reference projection (300*a*) within the first tactile octant, and a second tactile reference projection (300*b*) within the second tactile octant. Although FIG. 5 shows the tactile reference projection (300*a*) in the second octant (162) and second tactile reference projection (300*b*) in the sixth octant (166), the second tactile reference projection (300*b*) may also be located in the first octant (161), the third octant (163), the fourth octant (164), the fifth octant (165), the seventh octant (167), or the eighth octant (168) with respect to the positioning of the tactile reference indentation (200*a*) and how the octants (161, 162, 163, 164, 165, 166, 167, 168) are defined in FIG. 5. Generally, the second tactile reference projection (300*b*) should be spaced from the tactile reference projection (300*a*) by at least a 10 degree angle, as measured from the point of intersection between the four imaginary vertical planes (20, 30, 40, 50), which point of intersection would typically be the geometric center of the proximal end (120), i.e., the butt end, of the sports equipment handle (100) from a top plan view. Such spacing ensures that first and second tactile reference projection (300*a*, 300*b*) are not so close together that a user would not be able to discern by tactile perception the two distinct tactile reference projection (300*a*, 300*b*).

By providing a second tactile reference projection (300*b*), there is an increased opportunity for both of the user's hands, and associated finger pads, thumb, and/or palm, to come into contact with the tactile reference projections (300*a*, 300*b*) in order to receive additional tactile biofeedback. As a result, the second tactile reference projection (300*b*) provides even more information that is available for processing by the user's natural attributes of sensibility, proprioception, and neuromuscular memory to enable the user to consistently hit, throw, or shoot a projectile with accuracy.

Figure 7:
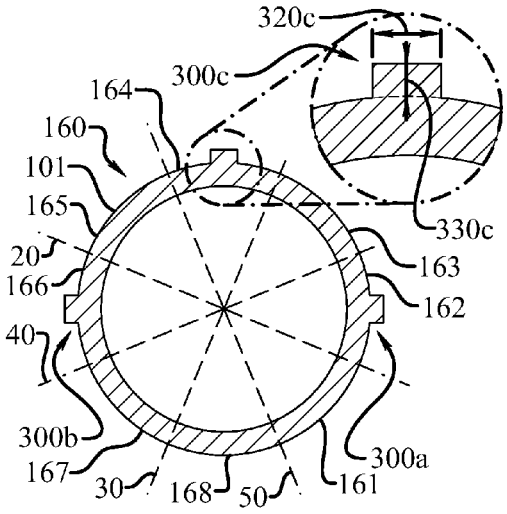
FIG. 7 is a cross-sectional view of an embodiment of a sports equipment handle, not to scale.
Figure 9:
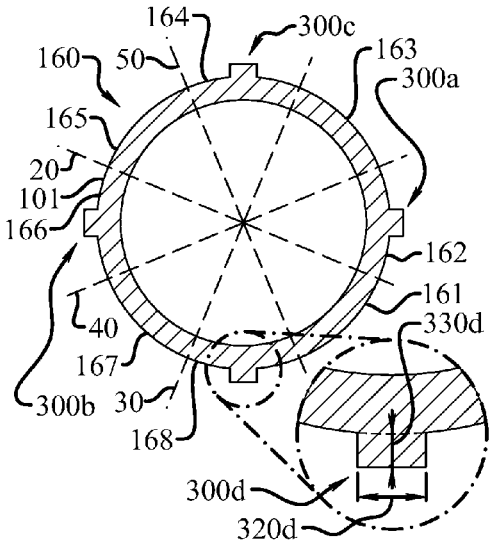
FIG. 9 is a cross-sectional view of an embodiment of the sports equipment handle, not to scale.

FIGS. 7 and 9 shows are cross-sectional views illustrating embodiments having multiple tactile reference indentations including at least two tactile reference projections in non-adjacent octants and at least two non-adjacent octants having no palpable indicia. It should be noted that the embodiments shown in FIGS. 7 and 9 do not reflect all the possible combinations of arrangements at least two tactile reference projections in non-adjacent octants and at least two non-adjacent octants having no palpable indicia but rather two illustrative embodiments. Again, these embodiments ensure sufficient spacing of the tactile reference projections (300*a*, 300*b*) to avoid providing competing tactile information that could be misinterpreted by the user's natural body processes of sensibility, proprioception, and neuromuscular memory.

The sports equipment handle (100) on a piece of sports equipment may be custom tailored to the end users specifications such that the tactile reference projection (300*a*) and the second tactile reference projection (300*b*) coincide with a pre-selected, user preferred, hand and finger placement on the sports equipment handle (100). As such, the first and/or second tactile reference projections (300*a*, 300*b*) additionally perform a "reminder" function. For example, the user will be able to feel the first and/or second tactile reference projections (300*a*, 300*b*) and know whether they are grasping the sports equipment handle (100) with their preferred hand and finger placement. By knowing that the first and/or second tactile reference projections (300*a*, 300*b*) coincide with the preferred hand and finger placement and being able to tactilely perceive the first and/or second tactile reference projections (300*a*, 300*b*), the user will have a higher level of psychomotor confidence, which results in a better sports equipment control.

Figure 11:
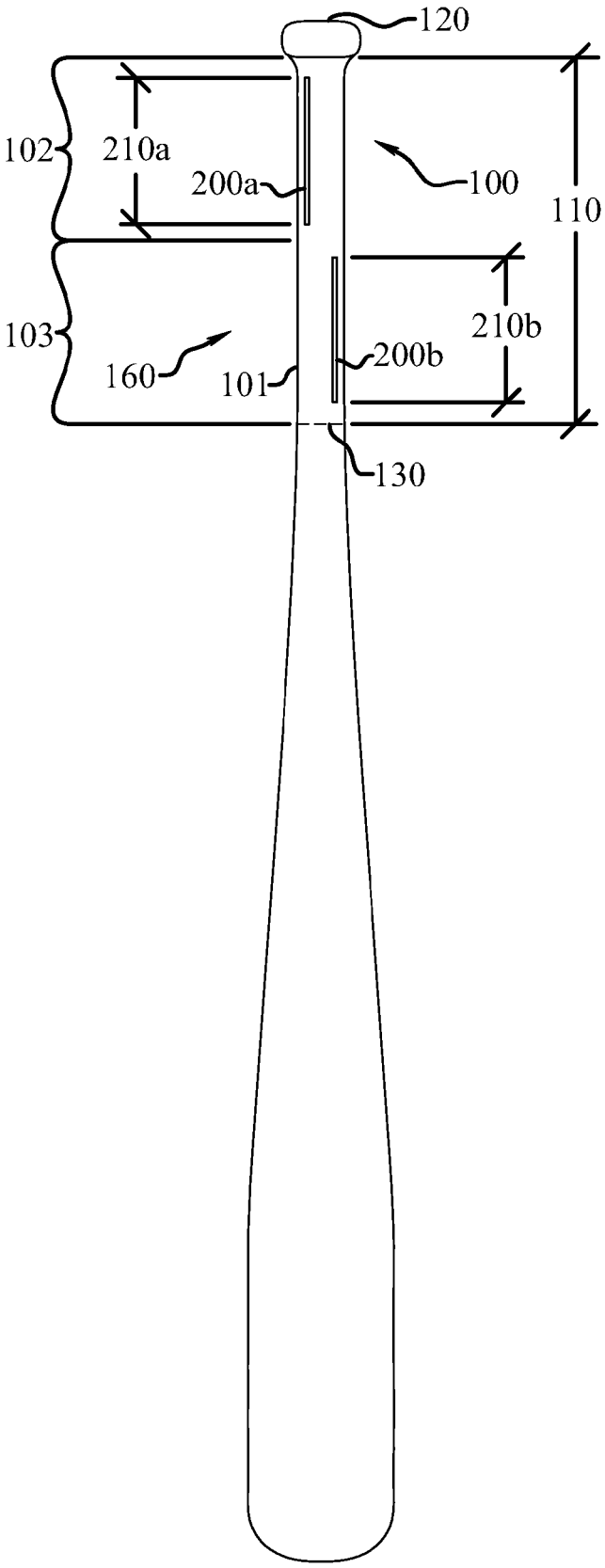
FIG. 11 is a front elevation view of an embodiment of a sports equipment handle on a baseball bat, not to scale.

Referring now to FIG. 11, an additional embodiment of the sports equipment handle (100) having a tactile reference indentation (200*a*) and a second tactile reference indentation (200*b*) is shown. In this particular embodiment, the tactile reference indentation (200*a*) is confined to the upper portion (102) of the sports equipment handle (100) and the second tactile reference indentation (200*b*) is confined to the lower portion (103) of the sports equipment handle (100). Although not specifically shown in FIG. 11, it should be noted that the tactile reference indentation (200*a*) and the second tactile reference indentation (200*b*) are confined to separate octants. This particular embodiment strategically positions the tactile reference indentation (200*a*) and the second tactile reference indentation (200*b*) so that the left thumb of a right-handed user contacts the tactile reference indentation (200*a*) and the user's right thumb contacts the second tactile reference indentation (200*b*). Thus, the user will be able to sense the first and/or second tactile reference indentations (200*a*, 200*b*), which harnesses their natural attributes of sensibility, proprioception, and neuromuscular memory to enable the user to consistently hit a projectile with accuracy. Of course, an embodiment suited for a left-handed person using a conventional handle is also contemplated. In the left-handed version of the sports equipment handle (100), the tactile reference indentation (200*a*) would be confined to the lower portion (103) and the second tactile reference indentation (200*b*) would be confined to the upper portion (102) such that that the left thumb of a left-handed user contacts the tactile reference indentation (200*a*) and/or the user's right thumb contacts the second tactile reference indentation (200*b*).

In another embodiment of the sports equipment handle (100) having a tactile reference projection (300*a*) and a second tactile reference projection (300*b*), the tactile reference projection (300*a*) is confined to the upper portion (102) of the sports equipment handle (100) and the second tactile reference projection (300*b*) is confined to the lower portion (103) of the sports equipment handle (100). In this embodiment, the tactile reference projection (300*a*) and the second tactile reference projection (300*b*) are confined to separate octants. This particular embodiment strategically positions the tactile reference projection (300*a*) and/or the second tactile reference projection (300*b*) so that the left thumb of a right-handed user contacts the tactile reference projection (300*a*) and/or the user's right thumb contacts the second tactile reference projection (300*b*). Thus, the user will be able to sense the first and/or second tactile reference projections (300*a*, 300*b*), which harnesses their natural attributes of sensibility, proprioception, and neuromuscular memory to enable the user to consistently hit, throw, or shoot a projectile with accuracy. Of course, an embodiment suited for a left-handed person using a conventional handle is also contemplated. In the left-handed version of the sports equipment handle (100), the tactile reference projection (300*a*) would be confined to the lower portion (103) and the second tactile reference projection (300*b*) would be confined to the upper portion (102) such that that the left thumb of a left-handed user contacts the tactile reference projection (300*a*) and/or the user's right thumb contacts the second tactile reference projection (300*b*).

Figure 12:
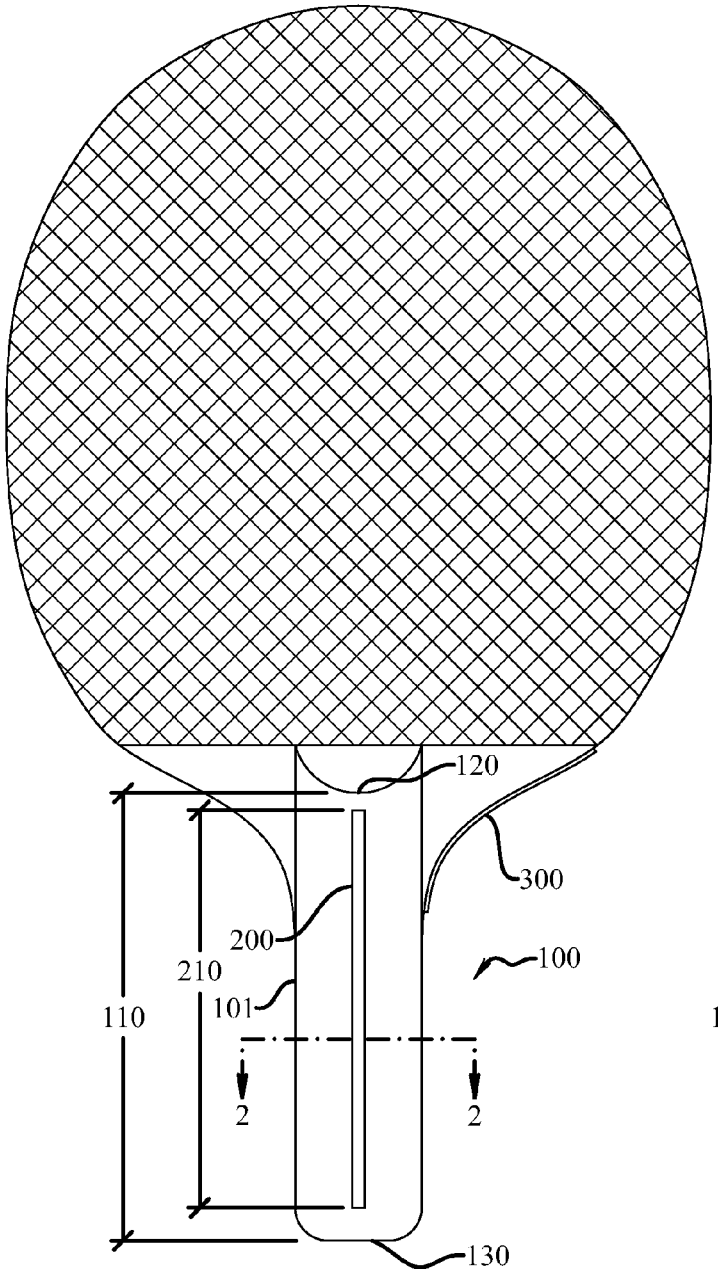
FIG. 12 is a front elevation view of an embodiment of a sports equipment handle on a ping-pong paddle, not to scale.

Referring now to FIG. 12, an embodiment of a sports equipment handle (100) on a ping pong paddle is illustrated. As seen in FIG. 12, the sports equipment handle (100) includes a handle body (101) having a handle length (110), a proximal end (120), a distal end (130), and an exterior body surface (160). FIG. 12 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly elliptical shape of a ping pong paddle handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 13:
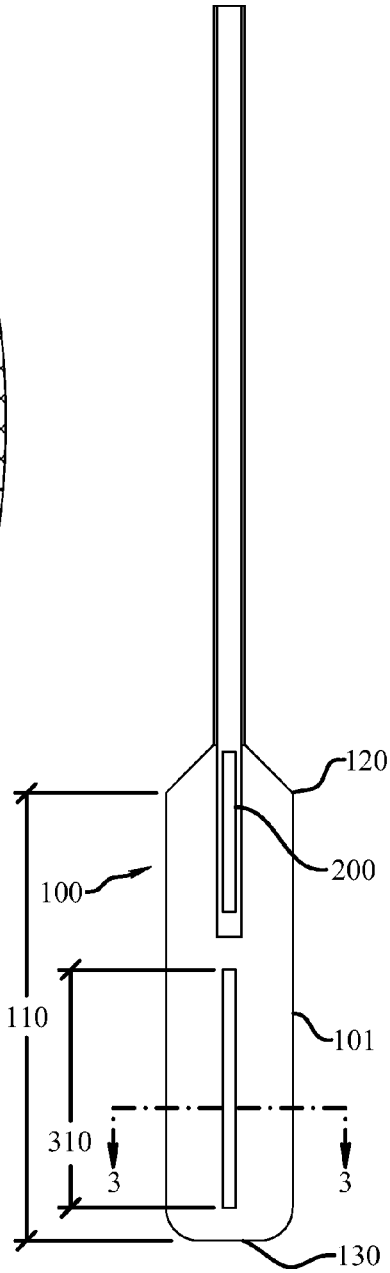
FIG. 13 is a side elevation view of an embodiment of a sports equipment handle on a ping-pong paddle, not to scale.

Referring now to FIG. 13, an embodiment of a sports equipment handle (100) on a ping pong paddle is illustrated. In this embodiment the sports equipment handle (100) includes a handle body (101) having a handle length (110), a proximal end (120), a distal end (130), and an exterior body surface (160). Just as the baseball bat embodiment may incorporate at least one tactile reference indentation (200), projection (300), or combination of the both, so to may all the embodiments disclosed herein, including the ping pong paddle embodiment currently discussed. Worth emphasizing one last time, FIG. 13 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly elliptical shape of a ping pong paddle handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Additionally, table tennis players use a wide variety of grip styles when holding a ping pong paddle, including the shakehand grip, the penhold grip, and the Seemiller grip. Many grip styles incorporate a portion of the user's gripping hand wrapping around the proximal end (120) of the handle (100) and a portion of the paddle surface itself. Thus, a further embodiment may incorporate a tactile reference projection (300) along an edge of the paddle surface, as seen in FIG. 12. Likewise, another embodiment may incorporate a tactile reference indentation (200) along an edge of the paddle surface, as seen in FIG. 13. In each of these embodiments the lineal length of the tactile reference projection (300) or indentation (200) is at least 0.5 inches long, but may extend several inches to accommodate a wide variety of gripping styles. In these embodiments the paddle edge tactile reference indentation (200) and/or projection (300) may be in addition to, or in lieu of, tactile reference features on the handle itself. Such paddle edge embodiments provide the user with additional biofeedback regarding the plane of the paddle surface via contact with the thumb, the index finger, and/or the area between the thumb and index finger, often referred to as the thenar space and/or webbing. The previously disclosed size of the tactile reference indentation (200) and projection (300) allow the user to spontaneously sense the orientation of the paddle surface.

Figure 14:
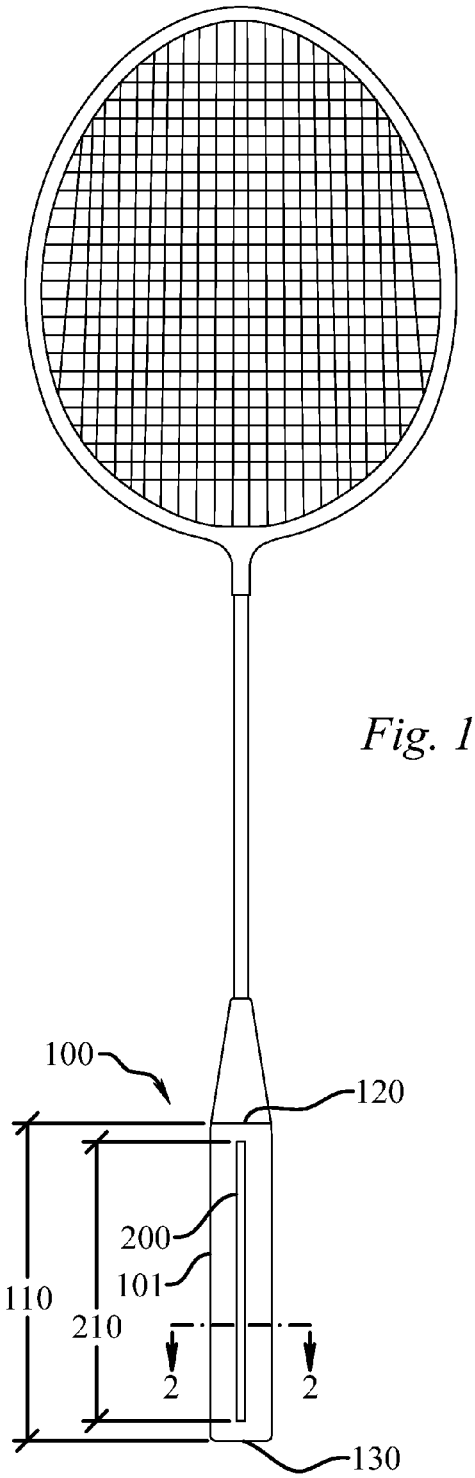
FIG. 14 is a front elevation view of an embodiment of a sports equipment handle on a badminton racquet, not to scale.
Figure 15:
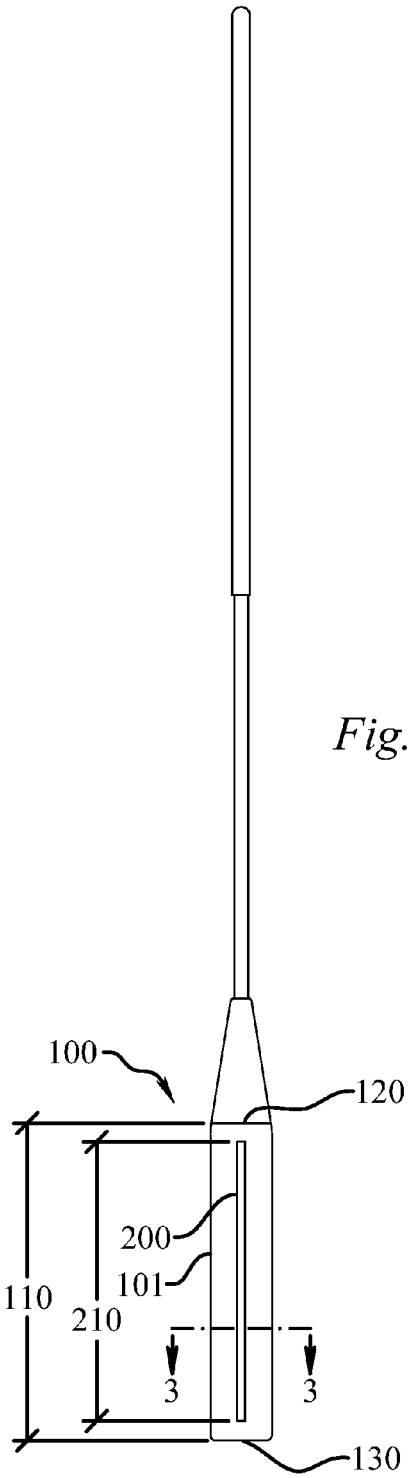
FIG. 15 is a side elevation view of an elevation view of an embodiment of a sports equipment handle on a badminton racquet, not to scale.

Referring now to FIG. 14, an embodiment of a sports equipment handle (100) on a badminton racquet is illustrated. As seen in FIG. 14, the sports equipment handle (100) includes a handle body (101) having a handle length (110), a proximal end (120), a distal end (130), and an exterior body surface (160). FIG. 14 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly multi-sided rectangular shape of a badminton racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Referring now to FIG. 13, an embodiment of a sports equipment handle (100) on a badminton racquet is illustrated. In this embodiment the sports equipment handle (100) includes a handle body (101) having a handle length (110), a proximal end (120), a distal end (130), and an exterior body surface (160). Just as the baseball bat embodiment and ping pong paddle embodiment may incorporate at least one tactile reference indentation (200), projection (300), or combination of the both, so to may all the embodiments disclosed herein, including the badminton racquet embodiment currently discussed. Worth emphasizing one last time, FIG. 13 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided rectangular shape of a badminton racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 16:
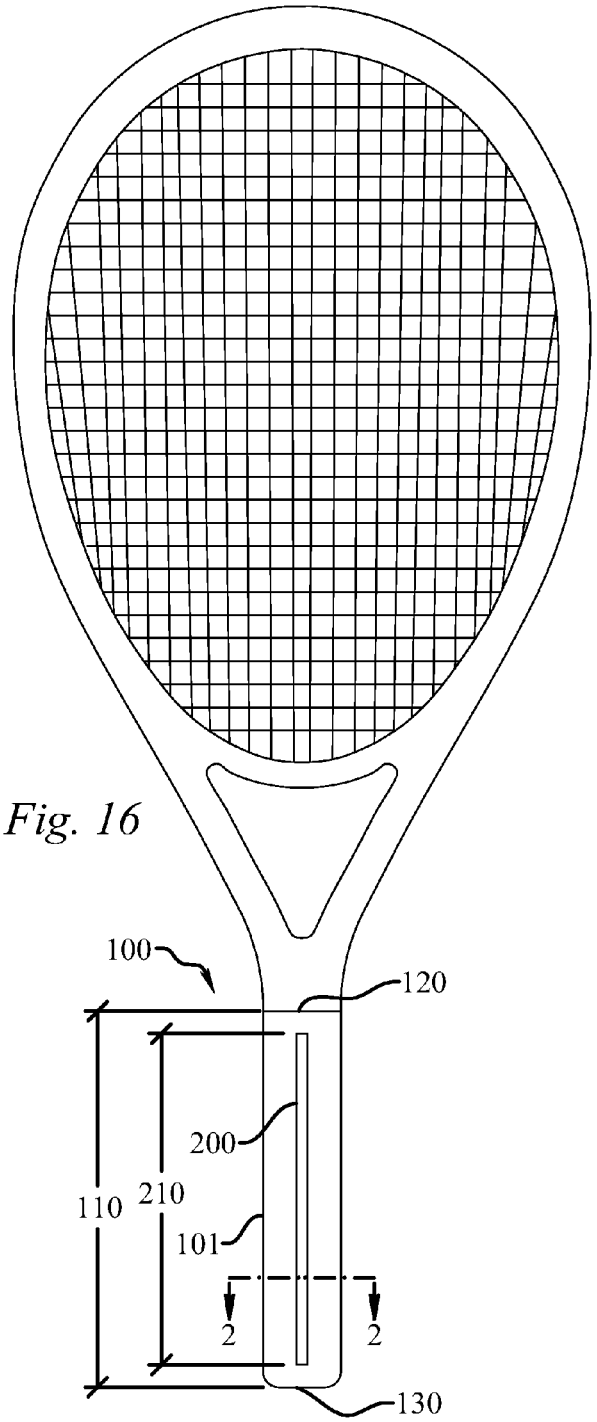
FIG. 16 is a front elevation view of an embodiment of a sports equipment handle on a tennis racquet, not to scale.

Referring now to FIG. 16, an embodiment of a sports equipment handle (100) on a tennis racquet is illustrated. As seen in FIG. 16, the sports equipment handle (100) includes a handle body (101) having a handle length (110), a proximal end (120), a distal end (130), and an exterior body surface (160). FIG. 16 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly multi-sided rectangular shape of a tennis racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 17:
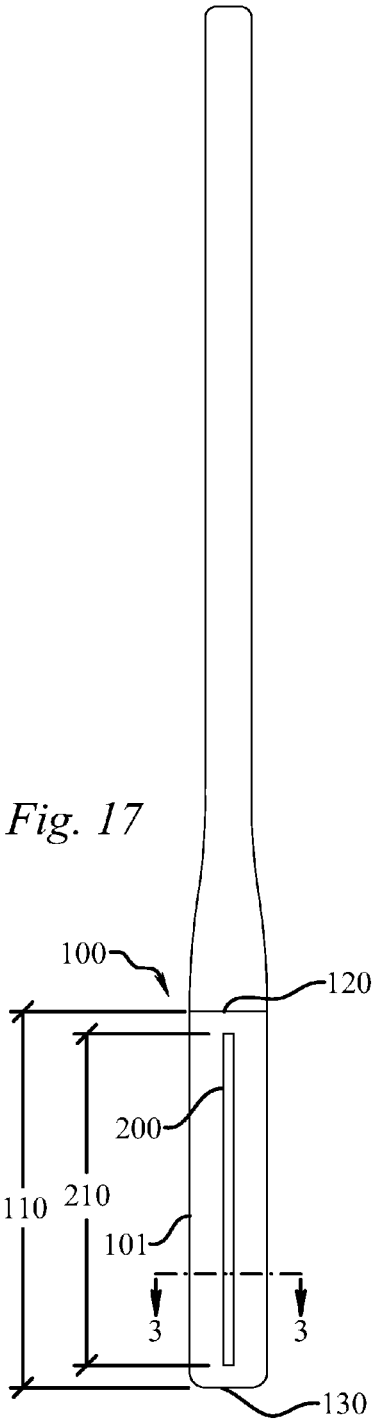
FIG. 17 is a side elevation view of an embodiment of a sports equipment handle on a tennis racquet, not to scale.

Referring now to FIG. 17, an embodiment of a sports equipment handle (100) on a tennis racquet is illustrated. In this embodiment the sports equipment handle (100) includes a handle body (101) having a handle length (110), a proximal end (120), a distal end (130), and an exterior body surface (160). Just as the baseball bat embodiment, ping pong paddle embodiment, and badminton racquet embodiment may incorporate at least one tactile reference indentation (200), projection (300), or combination of the both, so to may all the embodiments disclosed herein, including the tennis racquet embodiment currently discussed. Worth emphasizing again, FIG. 17 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided rectangular shape of a tennis racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 18:
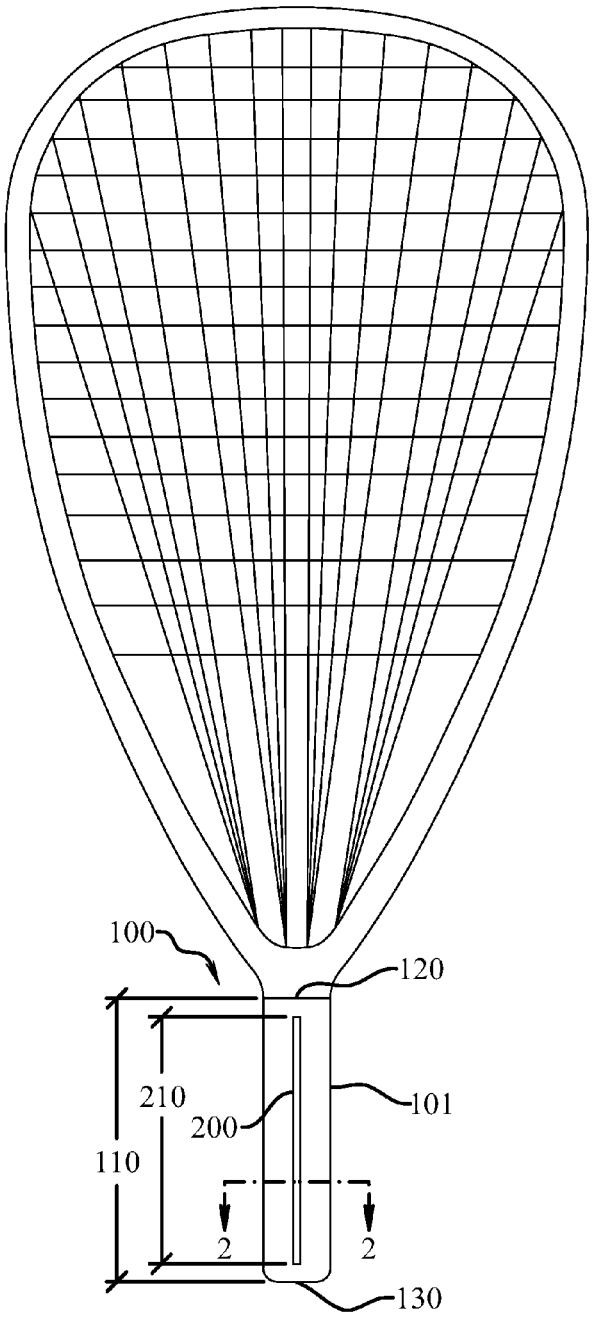
FIG. 18 is a front elevation view of an embodiment of a sports equipment handle on a racquet ball racquet, not to scale.

Referring now to FIG. 18, an embodiment of a sports equipment handle (100) on a racquetball racquet is illustrated. As seen in FIG. 18, the sports equipment handle (100) includes a handle body (101) having a handle length (110), a proximal end (120), a distal end (130), and an exterior body surface (160). FIG. 18 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly multi-sided rectangular shape of a racquetball racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 19:
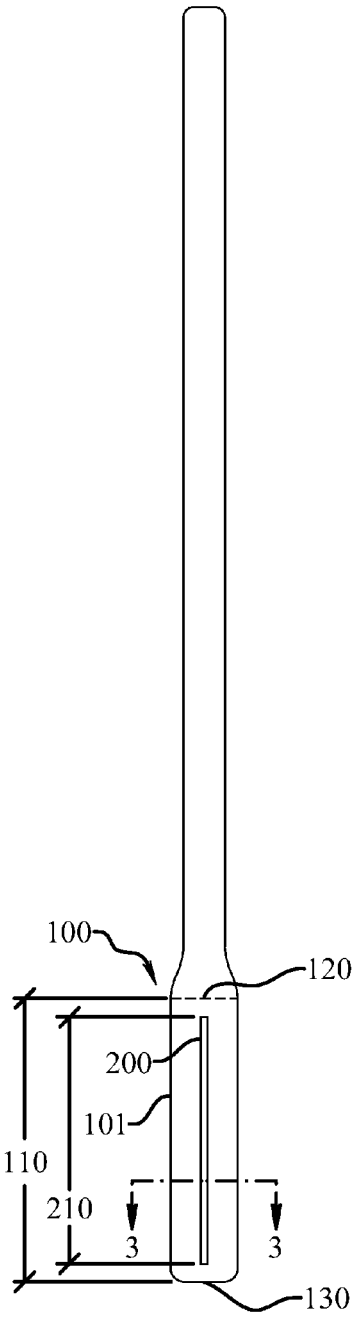
FIG. 19 is a side elevation view of an embodiment of a sports equipment handle on a racquet ball racquet, not to scale.

Referring now to FIG. 19, an embodiment of a sports equipment handle (100) on a racquetball racquet is illustrated. In this embodiment the sports equipment handle (100) includes a handle body (101) having a handle length (110), a proximal end (120), a distal end (130), and an exterior body surface (160). Just as the baseball bat embodiment, ping pong paddle embodiment, badminton racquet embodiment, and tennis racquet embodiment may incorporate at least one tactile reference indentation (200), projection (300), or combination of the both, so to may all the embodiments disclosed herein, including the racquetball racquet embodiment currently discussed. Worth emphasizing again, FIG. 19 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided rectangular shape of a racquetball racquet handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 20:
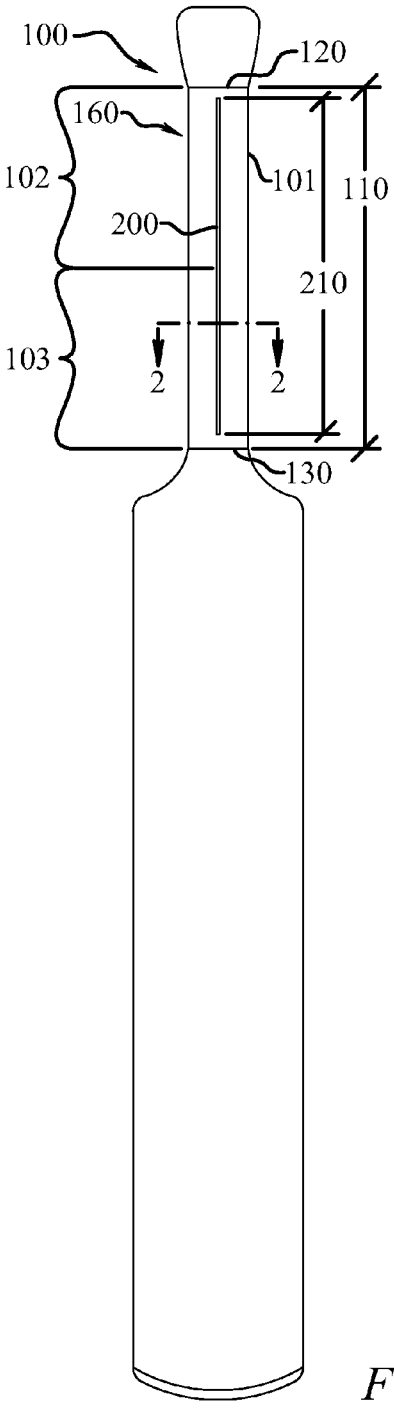
FIG. 20 is a front elevation view of an embodiment of a sports equipment handle on a cricket bat, not to scale.

Referring now to FIG. 20, an embodiment of a sports equipment handle (100) on a cricket bat is illustrated. As seen in FIG. 20, the sports equipment handle (100) includes a handle body (101) having a handle length (110), a proximal end (120), a distal end (130), and an exterior body surface (160). FIG. 20 includes a reference to section line 2-2 and the associated cross-section illustrated in FIG. 2. While the cross-sectional shape of FIG. 2 is circular, one skilled in the art will appreciate that the principles described herein apply equally to non-circular configurations such as the commonly elliptical shape of a cricket bat handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

Figure 21:
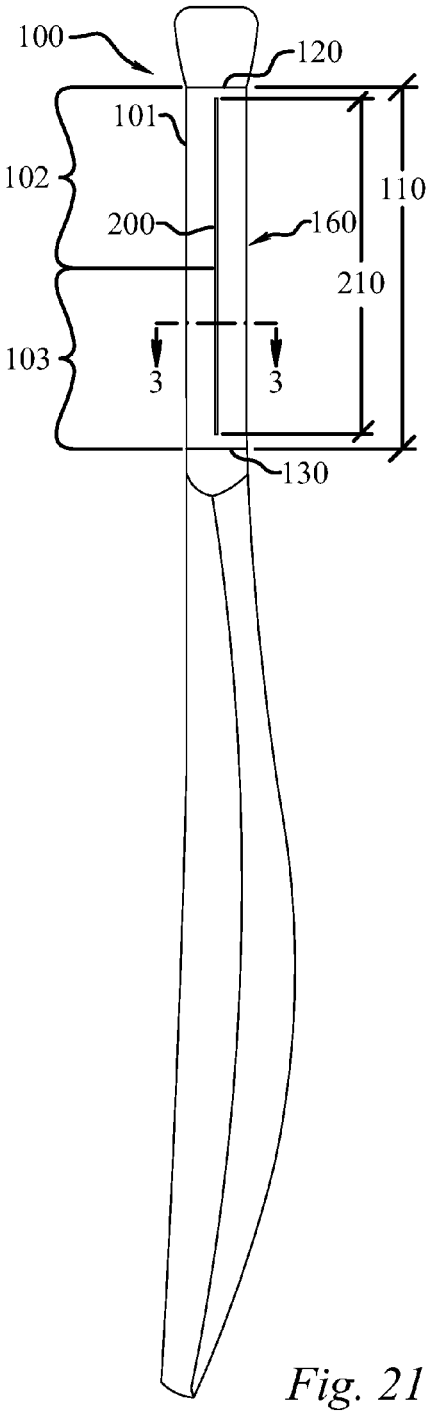
FIG. 21 is a side elevation view of an embodiment of a sports equipment handle on a cricket bat, not to scale.

Referring now to FIG. 21, an embodiment of a sports equipment handle (100) on a cricket bat is illustrated. In this embodiment the sports equipment handle (100) includes a handle body (101) having a handle length (110), a proximal end (120), a distal end (130), and an exterior body surface (160). Just as the baseball bat embodiment, ping pong paddle embodiment, badminton racquet embodiment, tennis racquet embodiment, and racquetball racquet embodiments may incorporate at least one tactile reference indentation (200), projection (300), or combination of the both, so to may all the embodiments disclosed herein, including the cricket bat embodiment currently discussed. Worth emphasizing again, FIG. 21 includes a reference to section line 3-3 and the associated cross-section illustrated in FIG. 3. While the cross-sectional shape of FIG. 3 is circular, one skilled in the art will appreciate that the principles described herein apply equally to non-circular configurations such as the commonly multi-sided elliptical shape of a cricket bat handle. Thus, reference to FIGS. 2-9 are not limited to circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein.

In each of the embodiments described above the tactile reference indentation length (210) and the tactile reference projection length (310) is at least 25 millimeters to ensure a substantial portion of at least one hand is in contact with the indentation or projection while gripping the handle (100). In one particular preferred embodiment the tactile reference indentation length (210) and the tactile reference projection length (310) is at least six inches to ensure a substantial portion of at least one hand is in contact with the indentation or projection while gripping the handle (100) while allowing a degree of flexibility in the actual location that a user places their hand(s) on the handle (100).

Figure 22:
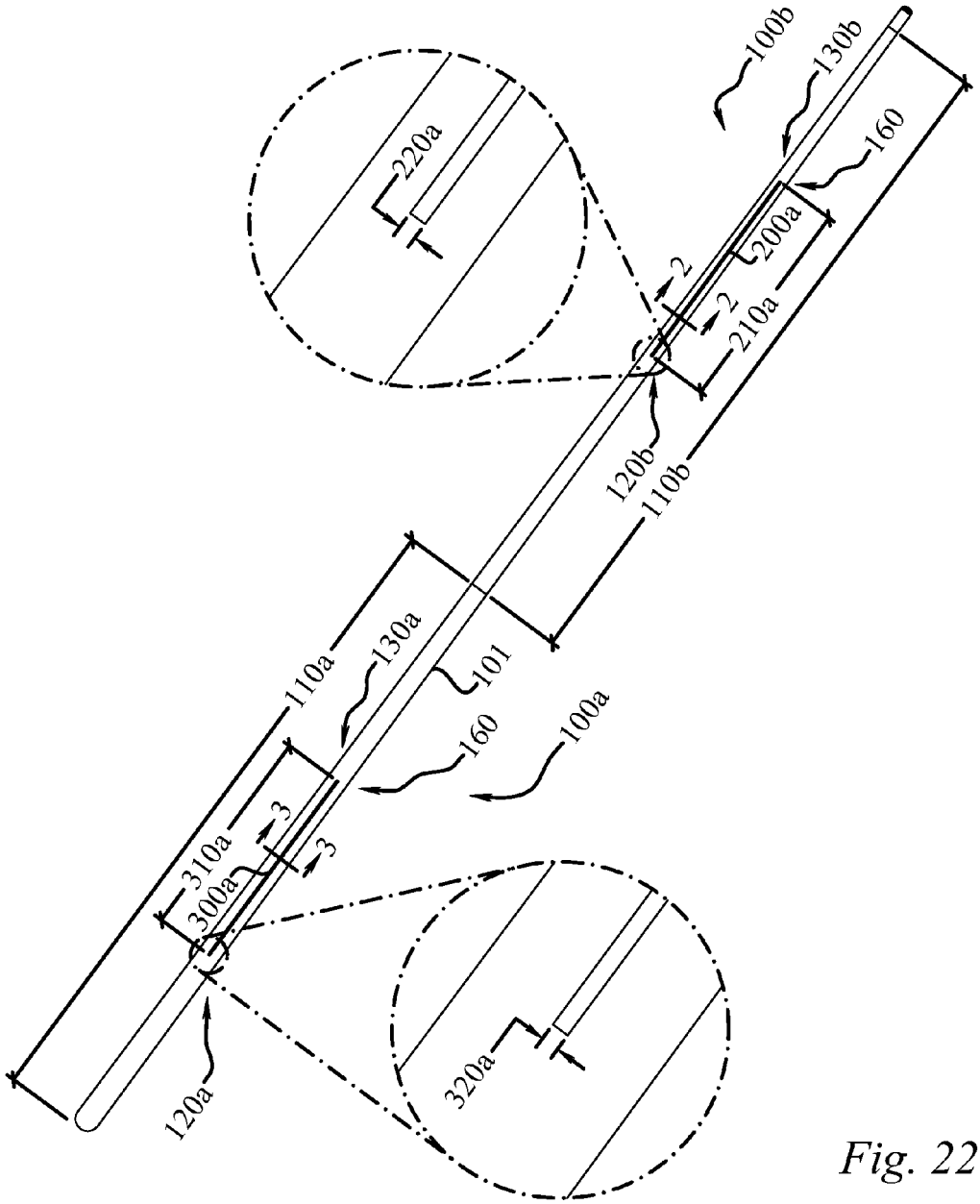
FIG. 22 is a front elevation view of an embodiment of a sports equipment handle on a pool cue, not to scale.

Referring now to FIG. 22, an embodiment of a sports equipment handle (100*a*) on a pool cue is illustrated. A pool cue is generally contacted by both hands of a user and therefore includes two handle sections, namely a top section (100*a*) and a bottom section (100*b*). The top section (100*a*) has a top section handle length (110*a*), a top section proximal end (120*a*), and a top section distal end (130*a*). The bottom section (100*b*) has a bottom section handle length (110*b*), a bottom section proximal end (120*b*), and a bottom section distal end (130*b*). As with all prior embodiments, the pool cue embodiment has an exterior body surface (160).

The embodiment of FIG. 22 illustrates a tactile reference projection (300*a*) in the top section (100*a*) and a tactile reference indentation (200*a*) in the bottom section (100*b*), however one skilled in the art will understand that this is merely for simplicity and reference to both section line 2-2 and section line 3-3 in a single figure. The pool cue may include a tactile reference projection (300) in both sections (100*a*, 100*b*), a tactile reference indentation (200) in both sections, or any possible mix of projections (300) and indentations (200) on a single cue stick, including having projections (300) and indentations (200) in the same section (100*a*, 100*b*) but different octants, as is true will all the embodiments herein. One skilled in the art will appreciate that the principles described above with respect to FIGS. 2-9 apply equally to this embodiment. Thus, reference to FIGS. 2-9 are referenced herein merely for illustration of the placement of the tactile reference indentation (200) or projection (300) with respect to the various octants of a handle sections (100*a*, 100*b*). The discussion above with respect to FIGS. 2-9 will not be repeated here but merely referenced as applying to all the embodiments disclosed herein.

In one embodiment the tactile reference indentation (200) or the tactile reference projection (300) located in the bottom section (110*b*) is preferably located within twenty-four inches of the ball-striking tip of the cue stick, and the length (210, 310) is at least six inches. In another embodiment the tactile reference indentation (200) or the tactile reference projection (300) located in the top section (110*a*) is preferably located within twenty-four inches of the butt-end of the cue stick, and the length (210, 310) is at least six inches. A right handed player will typically grip the cue stick with the right hand in the top section (110*a*), while using their left hand to guide the bottom section (110*b*) of the cue stick throughout the stroke. In a further embodiment the tactile reference indentation (200) or projection (300) extends majority of the length of the pool cue with no distinction between a separate indentation or projection in the top section (110*a*) or the bottom section (110*b*).

Generally professional pool players do not rotate the pool cue when making a stroke with the pool cue. However new players almost always rotate the pool cue one direction when pulling back to make a pool shot, and then rotate the pool cue back during the actual pool shot. Unfortunately, the rotation of the pool cue increases the likelihood of inaccurate shots. In addition to all the benefits discussed above, tactile reference indentations (200) and/or tactile reference projections (300) on a pool cue help the pool player become aware of any rotating motion during a pool shot, thereby resulting in a more accurate ball strikes. The tactile reference indentation (200) and/or projection (300) allow the user to deliver the pool cue without rotation and in an exact preselected spot on the cue ball to create the direction and rotation desired. Further, the tactile reference indentation (200) or projection (300) in the bottom section (110*b*) provides the user with a greater sense of whether the stroke of the cue stick is in perfect alignment with the desired direction of ball travel, or if the stroke of the cue stick is cutting across the ball.

Figure 23:
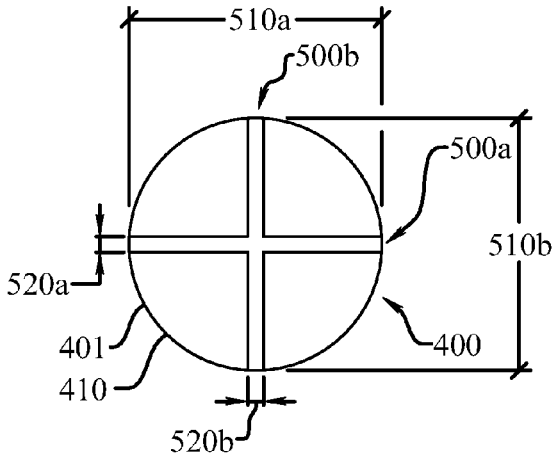
FIG. 23 is a bottom elevation view of a pool cue end cap, not to scale.
Figure 24:
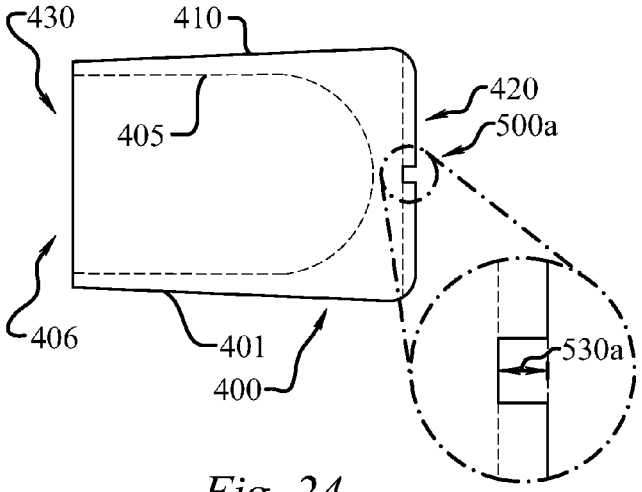
FIG. 24 is a side elevation view of a pool cue end cap, not to scale.
Figure 25:
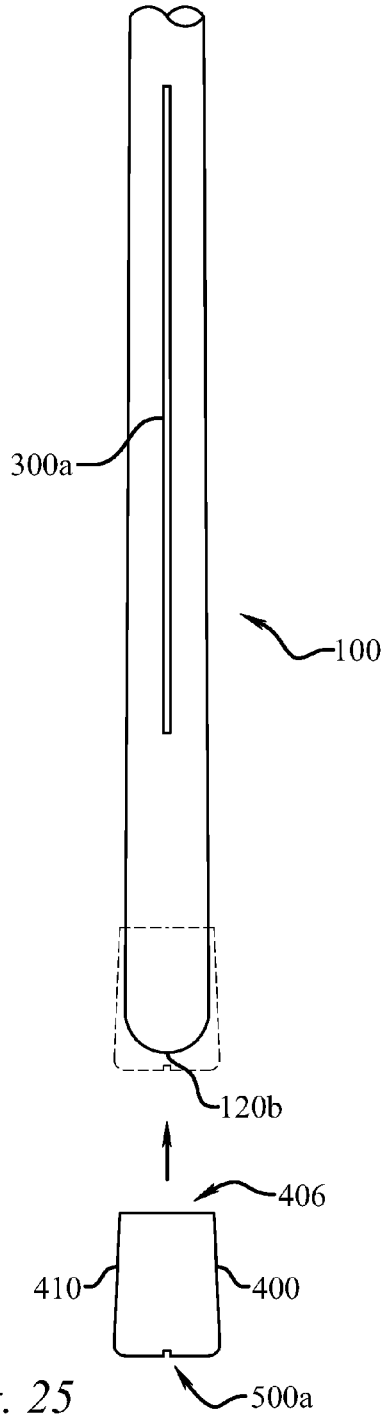
FIG. 25 is a front elevation view of a pool cue end cap and pool cue, not to scale.

The end of a pool cue is illustrated in FIGS. 23-25. The discussion of these figures will reference a pool cue end cap (400) as a separate attachment that may be applied to the end of a pool cue, however one skilled in the art will appreciate that the elements of the end cap (400), namely the pool cue tactile reference indentation (500) or pool cue tactile reference projection, and benefits afforded there from, may also be obtained by the elements being formed directly in the end of the pool cue and are hereby an embodiment of this invention. While separate drawings are not included for the pool cue tactile reference projection, by this point in the disclosure one skilled in the art will understand that the pool cue tactile reference indentation (500) shown in FIGS. 23-25 may just as easily be a projection consistent with the other figures and disclosure.

Some pool players like to wrap a finger, fingers, or even the palm of the hand, around the end of the pool cue when making a shot. In this situation, the pool cue tactile reference indentation (500) or projection gives the player biofeedback regarding the position of the pool cue in the same manner discussed above with respect to other embodiments, thereby helping the player make better shots. The pool cue end cap (400) may have an end cap body (401) having an end cap proximal end (420), an end cap distal end (430), an end cap interior surface (405) and an end cap exterior surface (410). Additionally, the end cap (400) has a pool cue end cap interior aperture (406) located on the pool cue end cap distal end (430). Located on the end cap proximal end (420) is at least end cap tactile reference indentation (500*a*) or projection having an end cap tactile reference indentation length (510*a*); an end cap tactile reference indentation width (520*a*), as seen in FIG. 23; and an end cap tactile reference indentation depth (530*a*) or height, as seen in FIG. 24. The pool cue end cap (400) is installed on a pool cue sports equipment handle (100) by sliding the bottom section proximal end (120*b*) of sports equipment bottom section handle body (101*b*) inside of the pool cue end cap interior aperture (406), as seen in FIG. 25. Another embodiment of the pool cue cap (400) has at least two end cap tactile reference indentations (500*a* and 500*b*) or projections oriented 90 degrees from each other forming an "X" shape pattern as seen in FIG. 23.

Figure 26:
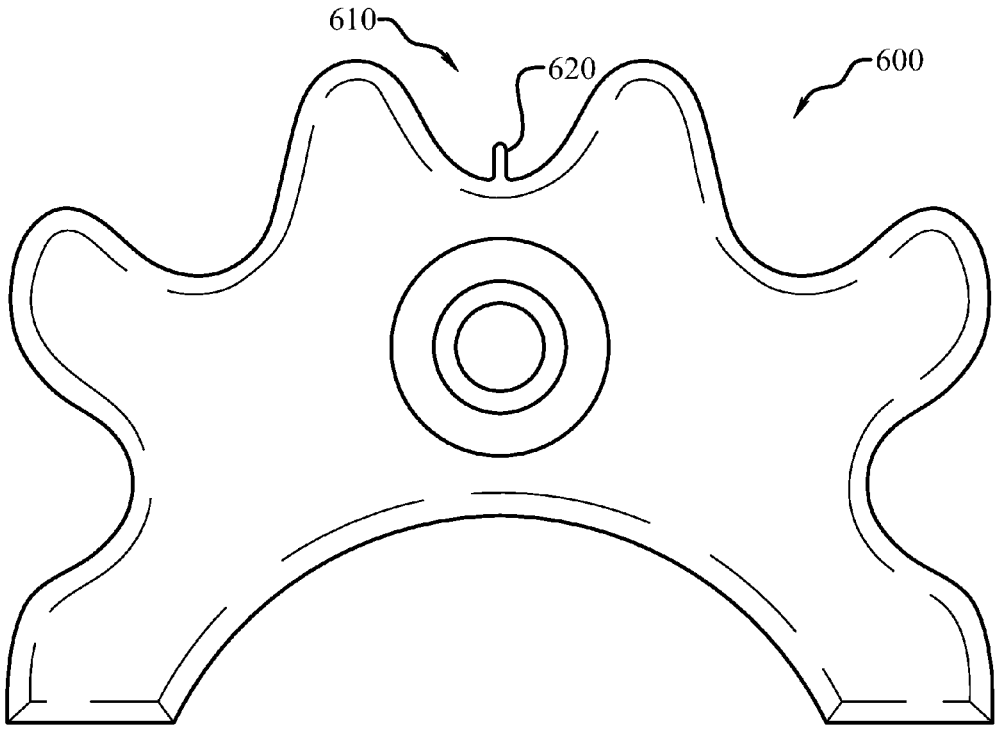
FIG. 26 is an elevation view of a pool cue bridge, not to scale.

Referring now to FIG. 26, is a pool cue bridge (600) including at least one pool cue trough (610) in which a pool cue is slid in a linearly fashion, having a pool cue guidance projection (620). The pool cue guidance projection (610) is inserted into a pool cue's sport equipment handle bottom section (100*b*) tactile reference indentation (200*a*) thereby allowing linear pool cue motion while preventing rotational movement that would throw off a pool shot.

Figure 27:
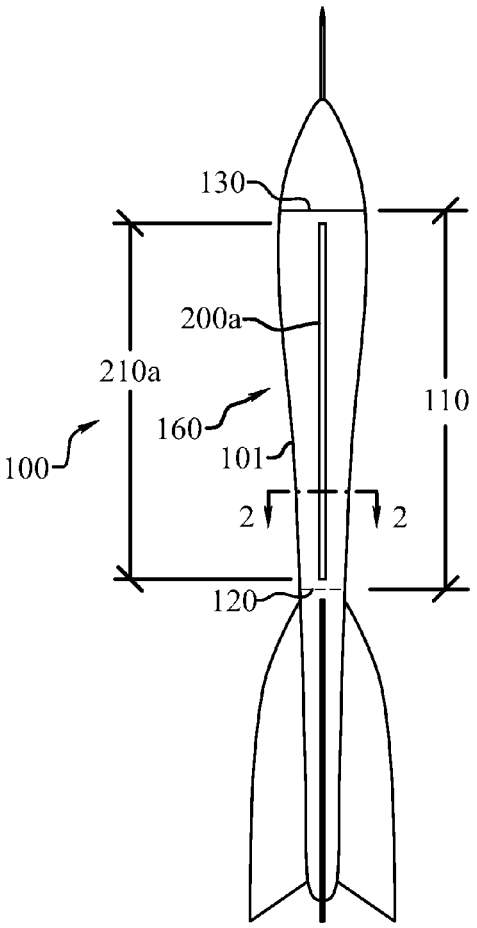
FIG. 27 is a front elevation view of an embodiment of a sports equipment handle on a dart, not to scale.
Figure 28:
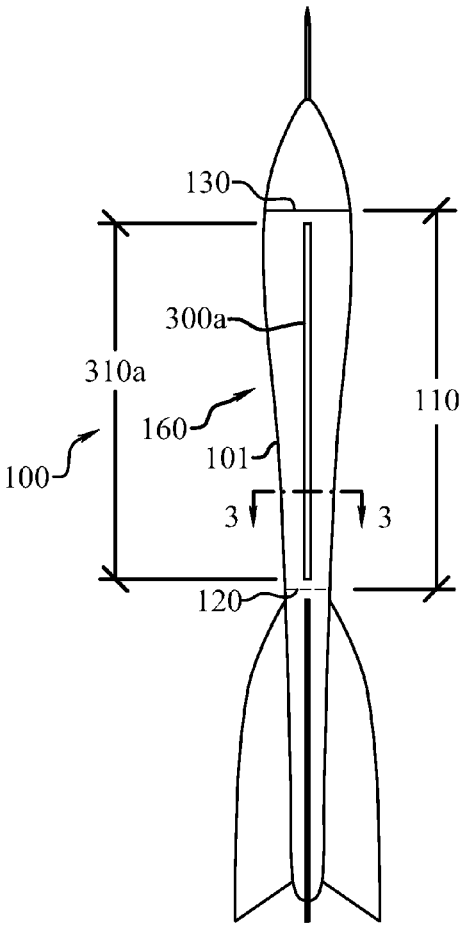
FIG. 28 is a front elevation view of an embodiment of a sports equipment handle on a dart, not to scale.

Referring now to FIG. 27, an embodiment of a sports equipment handle (100) on a throwing dart is illustrated incorporating at least one tactile reference indentation (200*a*). Similarly, FIG. 28 illustrates an embodiment of a sports equipment handle (100) on a throwing dart that incorporates at least one tactile reference projection (300*a*). As with the other disclosed sports equipment handles (100), the throwing dart handle includes a handle body (101) having a handle length (110), a proximal end (120), a distal end (130), and an exterior body surface (160). The tactile reference indentation (200*a*) embodiment of FIG. 27 includes a reference to section line 2-2 and the associated cross-section illustrated in FIG. 2, while the tactile reference projection (300*a*) includes a reference to section line 3-3 and the associated cross-section illustrated in FIG. 3. The disclosure above with respect to at least one tactile reference indentation (200) and/or at least one tactile reference projection (300), the size and placement of them, and the benefits afforded, also apply to this throwing dart embodiment and will not be repeated here for the sake of brevity.

When throwing a dart it is important that the dart player release the dart in a linear fashion without rotational or yaw movements. The tactile reference indentations (200) and/or tactile reference projections (300) help the dart player orient the dart during a throw to reduce both rotational and yaw movements, thereby allowing for more accurate throws.

Figure 29:
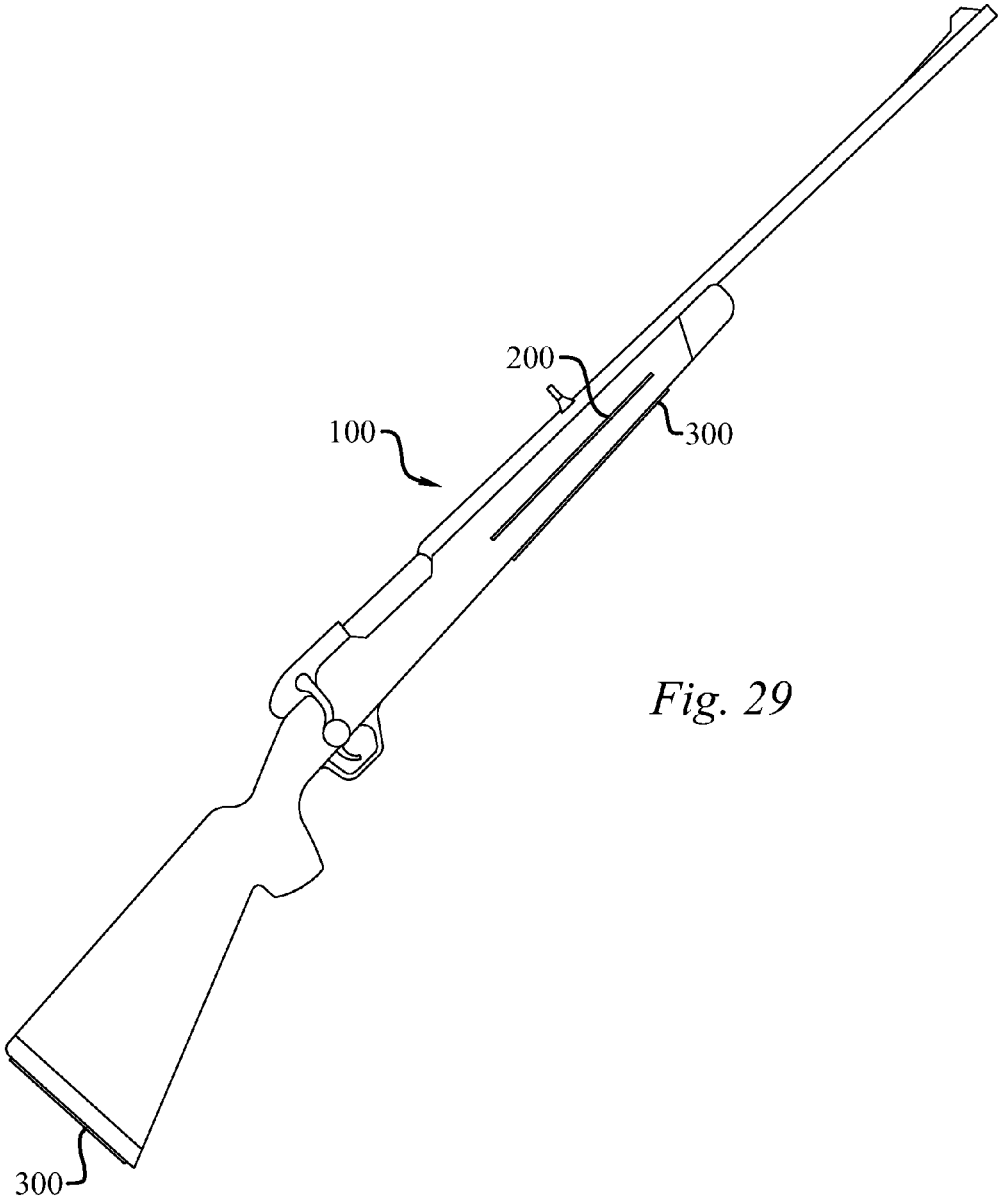
FIG. 29 is an elevation view of an embodiment of a sports equipment handle on a firearm, not to scale.

Referring now to FIG. 29, an embodiment of a sports equipment handle (100) on a firearm such as a rifle or shotgun. In this embodiment the tactile reference indentation (200) or projection (300) may be located on the stock, the forestock, and/or the butt of the firearm. The example of FIG. 29 illustrates both at least one tactile reference indentation (200) and projection (300) in the forestock of the firearm merely for simplicity and reduction of duplicative drawings. As with all the prior embodiments, the sports equipment handle (100) of the firearm includes a handle body (101) having a handle length (110), a proximal end (120), a distal end (130), and an exterior body surface (160). While FIG. 29 does not specifically reference section lines 2-2 and 3-3, it is understood that the tactile reference indentation (200) and/or projection (300) are consistent with FIGS. 2-9 and the disclosure above with respect to size, location, and quantity. Reference to FIGS. 2-9 is not limited to the circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein. In this embodiment the tactile reference indentation (200) or projection (300) on the forestock will only be contacted by a single hand and therefore the length is at least 25 millimeters. The forestock of the firearm may be divided into octants as disclosed above with respect to FIGS. 2-9. Further, the butt of the firearm may include at least one tactile reference indentation (200) or projection (300) in a manner as similar to that of the pool cue disclosed and illustrated in FIGS. 23-25. Such tactile reference features may be formed directly in the butt end of the stock or in a pad that is attached to the stock. The tactile references of the butt end will be felt on the bare shoulder, or through lightweight clothing, of the shooter. Such firearm tactile reference indentation or projection gives the shooter biofeedback regarding the position and orientation of the firearm in the same manner discussed above with respect to other embodiments, thereby helping the shooter properly position the firearm and make better shots. Another embodiment of the firearm butt tactile reference feature has at least two reference indentations or projections oriented 90 degrees from each other forming an "X" shape pattern as seen in FIG. 23.

Figure 30:
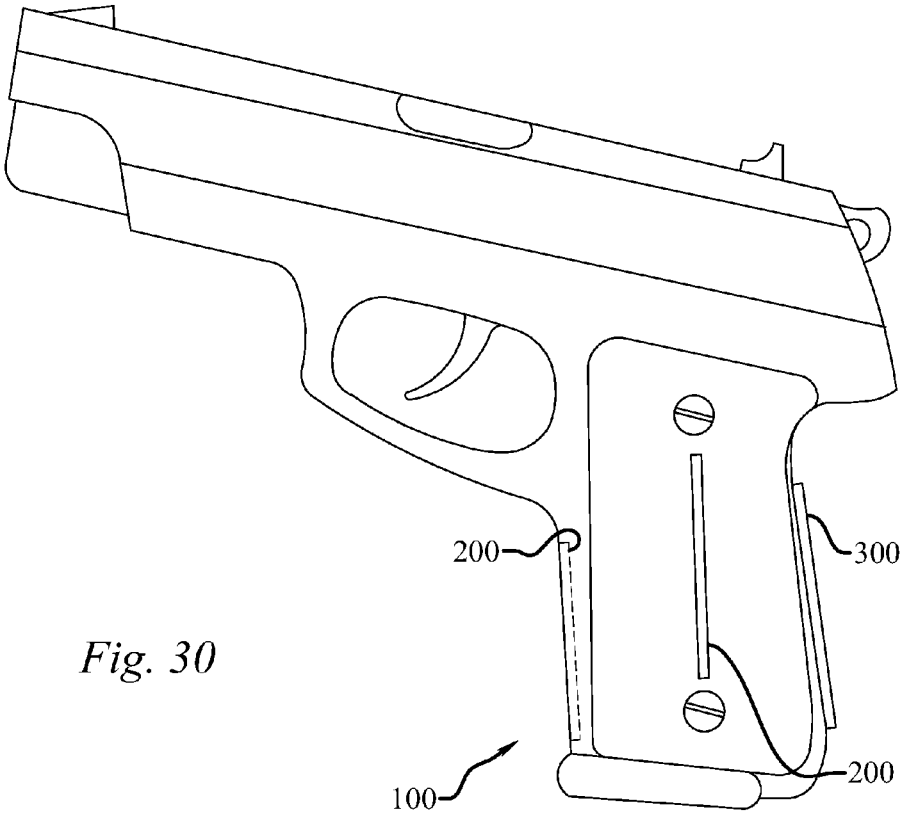
FIG. 30 is an elevation view of an embodiment of a sports equipment handle on a firearm, not to scale.

Referring now to FIG. 30, an embodiment of a sports equipment handle (100) on a pistol. In this embodiment the tactile reference indentation (200) or projection (300) is located on the grip of the firearm. The example of FIG. 30 illustrates both at least one tactile reference indentation (200) and projection (300) on a single pistol grip merely for simplicity and reduction of duplicative drawings. As with all the prior embodiments, the sports equipment handle (100) of the pistol includes a handle body (101) having a handle length (110), a proximal end (120), a distal end (130), and an exterior body surface (160). While FIG. 30 does not specifically reference section lines 2-2 and 3-3, it is understood that the tactile reference indentation (200) and/or projection (300) are consistent with FIGS. 2-9 and the disclosure above with respect to size, location, and quantity. Reference to FIGS. 2-9 is not limited to the circular handle embodiments illustrated and are referenced herein merely for illustration of the placement of the tactile reference indentation (200) or projection (300) with respect to the various octants of a handle. The principles apply regardless of the exterior cross-sectional shape of the handle and therefore the discussion above with respect to FIGS. 2-9 will not be repeated here but merely referenced as applying to all the embodiments disclosed herein. In this embodiment the tactile reference indentation (200) or projection (300) on the pistol grip will only be contacted by a single hand and therefore the length is at least 25 millimeters. Such pistol grip tactile reference indentation or projection gives the shooter biofeedback regarding the position and orientation of the firearm in the same manner discussed above with respect to other embodiments, thereby helping the shooter properly position the pistol and make better shots. An archery bow is held in front of a shooter in a fashion similar to that of a pistol. Therefore, one skilled in the art will appreciate that a tactile reference indentation (200) and/or projection (300) may be incorporated into the handle of a bow to provide the same benefits discussed throughout this application.

The sports equipment handle (100) may be produced from a variety of materials. By way of example only, and not limitation, the sports equipment handle (100) may be constructed of any conventional handle material, such as wood, metal, rubber, synthetic rubber, polymers, composites, and combinations thereof. The hardness of these types of materials is most commonly measured by the Shore (Durometer) test. Shore Hardness, using either the Shore A or Shore D scale, is the preferred method for rubbers/elastomers. The Shore A scale is used for "softer" rubbers while the Shore D scale is used for "harder" ones. The Shore hardness is measured with an apparatus known as a Durometer and consequently is also known as "Durometer hardness." The hardness value is determined by the penetration of the Durometer indenter foot into the sample. The ASTM test method designation is ASTM D2240 00 and is generally used in North America. Related methods include ISO 7619 and ISO 868; DIN 53505; and JIS K 6301, which was discontinued and superceeded by JIS K 6253.

Some of the embodiments disclosed herein, including but not limited to badminton racquet handles, racquetball racquet handles, tennis racquet handles, cricket bat handles, cue sticks, and archery/firearms, the handles may be covered with a grip, often made of a softer leather or synthetic material applied to the handle. Such grips may incorporate the tactile reference indentation (200) and projection (300) disclosed herein. Thus, this disclosure concerning the size and location of the tactile reference indentation (200) and projection (300) applies equally to grips that are then applied over the handles.

The palm side of the human hand has a durometer value ranging from approximately 25 to approximately 35 Shore A on the hardness scale. In yet another embodiment, the durometer of the sports equipment handle (100), the tactile reference indentation (200), and/or the tactile reference projection (300) is at least 70 percent greater than the durometer value of the palm side of the human hand. Thus, in one embodiment the sports equipment handle (100), the tactile reference indentation (200), and/or the tactile reference projection (300) has a durometer value greater than 60 Shore A on the hardness scale to ensure that the sports equipment handle (100), the tactile reference indentation (200), and/or the tactile reference projection (300) is significantly harder than the portion of the human hand, and therefore the tactile reference indentation and/or projection is even more perceivable. In an even further embodiment the sports equipment handle (100) has a durometer value of at least 65 Shore A on the hardness scale to ensure that the sports equipment handle (100) is significantly harder than the portion of the human hand.

Thus, one skilled in the art will appreciate that an even further embodiment consists of at least one tactile reference projection (300) that may be applied to the handle of a pre-existing piece of sports equipment. For instance, one embodiment may incorporate a kit of one or more one tactile reference projections (300) that may be adhered to the handle of an ordinary piece of sports equipment. For example, a user may apply a tactile reference projection (300) to the handle of a standard baseball bat, or any other piece of sports equipment, to determine if the addition of the tactile reference projection (300) improves their ball striking, throwing, or shooting. Alternatively, the tactile reference indentation (200) or projection (300) may be formed in the handle of piece of sports equipment utilizing traditional handle manufacturing processes.

In the case of a grip applied over a handle, or a nonmetallic handle, the grip, handle, or tactile reference indentation (200) or projection (300) may be made of rubber, synthetic rubber or polymers, which may be produced by injection molding or extrusion molding. Often conventional handle molding techniques are limited in their ability to produce a sports equipment handle (100) having a tactile reference indentation (200*a*) or a tactile reference projection (300*a*) with distinct sharp edges, i.e., zero radius edges. Therefore, the sports equipment handle (100) may be formed by a molding process followed by a CNC machining process. Additionally, the sports equipment handle (100) may be produced by an advanced compression molding process, laser cutting, or a water jet. Furthermore, a sports equipment handle (100) that is made out of wood, metal, or composites, and combinations thereof may be formed by CNC machining, laser cutting, and or water jet cutting to form the basic shape of the sports equipment handle (100) and any tactile reference indentations (200) or tactile reference projections (300) found thereon.

Thus far the disclosure has included baseball bat embodiments, ping pong paddle embodiments, badminton racquet embodiments, tennis racquet embodiments, racquetball racquet embodiments, cricket bat embodiments, pool cue embodiments, dart embodiments, and archery/firearm embodiments; one skilled in the art will appreciated that the disclosure applies equally to the squash racquets, curling stone handles, pole vaulting pole handles, lacrosse stick handles, handles for water sport paddles such as kayak and canoe paddle handles, fishing rod handles and grips, fly fishing rod handles and grips, motorcycle and snowmobile handles and grips, discuses, javelins, and hammers which are included herein without the need for repetitive discussion. Numerous alterations, modifications, and variations of the preferred embodiments disclosed herein will be apparent to those skilled in the art and they are all anticipated and contemplated to be within the spirit and scope of the sports equipment handle (100). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the sports equipment handle (100) are described herein, it is to be understood that the practice of such additional modifications and variations and the equivalents thereof, are within the spirit and scope of the invention.

I claim:

1. A throwing dart comprising:

a tip;

a flight; and a handle (100) between the tip and the flight, the handle (100) having a handle body (101) having a handle length (110), a proximal end (120), a distal end (130), and an exterior body surface (160), wherein the exterior body surface (160) is defined by a first octant (161), a second octant (162), a third octant (163), a fourth octant (164), a fifth octant (165), a sixth octant (166), a seventh octant (167), and an eighth octant (168);

a first tactile reference indentation (200*a*) extending along the exterior body surface (160) and confined to a first tactile octant, wherein the first tactile octant is selected from the group consisting of the first octant (161), the second octant (162), the third octant (163), the fourth octant (164), the fifth octant (165), the sixth octant (166), the seventh octant (167), and the eighth octant (168), the first tactile reference indentation (200*a*) having a first tactile reference indentation length (210*a*), a first tactile reference indentation width (220*a*) of at least 2.0 millimeters and no greater than 5.0 millimeters, and a first tactile reference indentation depth (230*a*) of at least 0.5 millimeters, wherein the only palpable indicia within the first tactile octant is the first tactile reference indentation (200*a*), and wherein the first tactile reference indentation (200*a*) provides a user with tactile biofeedback by two-point discrimination when gripping the handle (100); and a second tactile reference indentation (200*b*) extending along the exterior body surface (160) and confined to a second tactile octant, wherein the second tactile octant is selected from the group consisting of the first octant (161), the second octant (162), the third octant (163), the fourth octant (164), the fifth octant (165), the sixth octant (166), the seventh octant (167), and the eighth octant (168) that does not include the first tactile reference indentation (200*a*), wherein the first tactile octant and the second tactile octant are not adjacent to one another, and the second tactile reference indentation (200*b*) having a second tactile reference indentation length (210*b*), a second tactile reference indentation width (220*b*) of at least 2.0 millimeters and no greater than 5.0 millimeters, and a second tactile reference indentation depth (230*b*) of at least 0.5 millimeters, and wherein the second tactile reference indentation (200*b*) provides the user with tactile biofeedback by two-point discrimination when gripping the handle (100).

2. The throwing dart of claim 1, wherein the first tactile reference indentation length (210*a*) is at least 50 percent of the handle length (110).

3. The throwing dart of claim 1, wherein at least two octants selected from the group consisting of the first octant (161), the second octant (162), the third octant (163), the fourth octant (164), the fifth octant (165), the sixth octant (166), the seventh octant (167), and the eighth octant (168) that do not include the first tactile reference indentation (200*a*), have no palpable indicia.

4. The throwing dart of claim 3, wherein the at least two octants having no palpable indicia are not adjacent to one another.

5. The throwing dart of claim 1, wherein the first tactile reference indentation (200*a*) has a durometer value of at least 65 Shore A on the hardness scale.

6. The throwing dart of claim 1, wherein at least four octants selected from the group consisting of the first octant (161), the second octant (162), the third octant (163), the fourth octant (164), the fifth octant (165), the sixth octant (166), the seventh octant (167), and the eighth octant (168) that do not include the first tactile reference indentation (200*a*) and the second tactile reference indentation (200*b*), have no palpable indicia, and the at least four octants having no palpable indicia are not adjacent to one another.

7. The throwing dart of claim 1, wherein the handle (100) further includes a third tactile reference indentation (200*c*) extending along the exterior body surface (160) and confined to a third tactile octant, wherein the third tactile octant is selected from the group consisting of the first octant (161), the second octant (162), the third octant (163), the fourth octant (164), the fifth octant (165), the sixth octant (166), the seventh octant (167), and the eighth octant (168) that does not include the first tactile reference indentation (200*a*) and does not include the second tactile reference indentation (200*b*), the third tactile reference indentation (200*c*) having a third tactile reference indentation length (210*c*), a third tactile reference indentation width (220*c*) of at least 2.0 millimeters and no greater than 5.0 millimeters, and a third tactile reference indentation depth (230*c*) of at least 0.5 millimeters, wherein the third tactile reference indentation (200*c*) provides a user with tactile biofeedback by two-point discrimination when gripping the handle (100), and wherein the first tactile octant, the second tactile octant, and the third tactile octant are not adjacent to one another.

8. The throwing dart of claim 7, wherein the handle (100) further includes a fourth tactile reference indentation (200*d*) extending along the exterior body surface (160) and confined to a fourth tactile octant, wherein the fourth tactile octant is selected from the group consisting of the first octant (161), the second octant (162), the third octant (163), the fourth octant (164), the fifth octant (165), the sixth octant (166), the seventh octant (167), and the eighth octant (168) that does not include the first tactile reference indentation (200*a*), does not include the second tactile reference indentation (200*b*), and does not include the third tactile reference indentation (200*c*), the fourth tactile reference indentation (200*d*) having a fourth tactile reference indentation length (210*d*), a fourth tactile reference indentation width (220*d*) of at least 2.0 millimeters and no greater than 5.0 millimeters, and a fourth tactile reference indentation depth (230*d*) of at least 0.5 millimeters, and wherein the fourth tactile reference indentation (200*d*) provides a user with tactile biofeedback by two-point discrimination when gripping the handle (100), and wherein the first tactile octant, the second tactile octant, the third tactile octant, and the fourth tactile octant are not adjacent to one another.

9. The throwing dart of claim 1, wherein the first tactile reference indentation (200*a*) has distinct exterior corner edges adjacent the outermost exterior body surface (160) with a radius of curvature of 0.35 millimeters or less, and the second tactile tactile reference indentation (200*b*) has distinct exterior corner edges adjacent the outermost exterior body surface (160) with a radius of curvature of 0.35 millimeters or less.

10. The throwing dart of claim 1, wherein the first tactile reference indentation (200*a*) and the second tactile reference indentation (200*b*) are spaced at least 90 degrees apart around the circumference of the exterior body surface (160).

11. A throwing dart comprising:

a tip;

a flight; and a handle (100) between the tip and the flight, the handle (100) having a handle body (101) having a handle length (110), a proximal end (120), a distal end (130), and an exterior body surface (160), wherein the exterior body surface (160) is defined by a first octant (161), a second octant (162), a third octant (163), a fourth octant (164), a fifth octant (165), a sixth octant (166), a seventh octant (167), and an eighth octant (168);

a first tactile reference projection (300*a*) extending along the exterior body surface (160) and confined to a first tactile octant, wherein the first tactile octant is selected from the group consisting of the first octant (161), the second octant (162), the third octant (163), the fourth octant (164), the fifth octant (165), the sixth octant (166), the seventh octant (167), and the eighth octant (168), the first tactile reference projection (300*a*) having a first tactile reference projection length (310*a*), a first tactile reference projection width (320*a*) of at least 2.0 millimeters and no greater than 5.0 millimeters, and a first tactile reference projection height (330*a*) of at least 0.5 millimeters, wherein the only palpable indicia within the first tactile octant is the first tactile reference projection (300*a*), and wherein the first tactile reference projection (300*a*) provides a user with tactile biofeedback by two-point discrimination when gripping the handle (100); and a second tactile reference projection (300*b*) extending along the exterior body surface (160) and confined to a second tactile octant, wherein the second tactile octant is selected from the group consisting of the first octant (161), the second octant (162), the third octant (163), the fourth octant (164), the fifth octant (165), the sixth octant (166), the seventh octant (167), and the eighth octant (168) that does not include the first tactile reference projection (300*a*), the second tactile reference projection (300*b*) having a second tactile reference projection length (310*b*), a second tactile reference projection width (320*b*) of at least 2.0 millimeters and no greater than 5.0 millimeters, and a second tactile reference projection height (330*b*) of at least 0.5 millimeters, wherein the second tactile reference projection (300*b*) provides the user with tactile biofeedback by two-point discrimination when gripping the handle (100), and wherein the first tactile octant and the second tactile octant are not adjacent to one another.

12. The throwing dart of claim 11, wherein the first tactile reference projection length (310*a*) is at least 50 percent of the handle length (110).

13. The throwing dart of claim 11, wherein at least two octants selected from the group consisting of the first octant (161), the second octant (162), the third octant (163), the fourth octant (164), the fifth octant (165), the sixth octant (166), the seventh octant (167), and the eighth octant (168) that do not include the first tactile reference projection (300*a*), have no palpable indicia.

14. The throwing dart of claim 13, wherein the at least two octants having no palpable indicia are not adjacent to one another.

15. The throwing dart of claim 11, wherein the first tactile reference projection (300*a*) has a durometer value of at least 65 Shore A on the hardness scale.

16. The throwing dart of claim 11, wherein at least four octants selected from the group consisting of the first octant (161), the second octant (162), the third octant (163), the fourth octant (164), the fifth octant (165), the sixth octant (166), the seventh octant (167), and the eighth octant (168) that do not include the first tactile reference projection (300*a*) and the second tactile reference projection (300*b*), have no palpable indicia, and the at least four octants having no palpable indicia are not adjacent to one another.

17. The throwing dart of claim 11, wherein the first tactile reference projection (300*a*) has distinct exterior corner edges adjacent the outermost exterior body surface (160) with a radius of curvature of 0.35 millimeters or less, and the second tactile tactile reference projection (300*b*) has distinct exterior corner edges adjacent the outermost exterior body surface (160) with a radius of curvature of 0.35 millimeters or less.

18. The throwing dart of claim 11, wherein the first tactile reference projection (300*a*) and the second tactile reference projection (300*b*) are spaced at least 90 degrees apart around the circumference of the exterior body surface (160).

* * * * *